US006897820B2

(12) United States Patent
Frenkel

(10) Patent No.: US 6,897,820 B2
(45) Date of Patent: May 24, 2005

(54) ELECTROMAGNETIC WINDOW

(75) Inventor: Avraham Frenkel, Kiriat Bjalik (IL)

(73) Assignee: Anafa-Electromagnetic Solutions Ltd., Kiriat Bialik (IL)

( * ) Notice: Subject to any disclaimer, the term of this patent is extended or adjusted under 35 U.S.C. 154(b) by 0 days.

(21) Appl. No.: 10/218,173

(22) Filed: Aug. 13, 2002

(65) Prior Publication Data

US 2003/0034933 A1 Feb. 20, 2003

(30) Foreign Application Priority Data

Aug. 17, 2001 (GB) ..... 0120075

(51) Int. Cl.[7] ..... H01Q 19/00
(52) U.S. Cl. ..... 343/756; 343/909
(58) Field of Search ..... 343/756, 909, 343/911 R, 842, 700 MS, 872

(56) References Cited

U.S. PATENT DOCUMENTS

| | | | | |
|---|---|---|---|---|
| 3,780,374 A | | 12/1973 | Shibano et al. | 343/872 |
| 3,864,690 A | * | 2/1975 | Pierrot | 343/872 |
| 4,358,772 A | | 11/1982 | Leggett | 343/872 |
| 4,467,330 A | | 8/1984 | Vidal et al. | 343/872 |
| 4,785,310 A | | 11/1988 | Rosen | 343/909 |
| 5,600,325 A | | 2/1997 | Whelan et al. | 342/13 |
| 5,958,557 A | | 9/1999 | Naor | 428/174 |
| 6,512,494 B1 | * | 1/2003 | Diaz et al. | 343/909 |

FOREIGN PATENT DOCUMENTS

| | | |
|---|---|---|
| EP | 0096529 | 12/1983 |
| EP | 0187437 | 7/1986 |
| GB | 2253519 | 9/1992 |
| GB | 2294813 | 8/1996 |
| GB | 2325784 | 2/1998 |
| GB | 2337860 | 1/1999 |
| GB | 2328319 | 2/1999 |
| WO | 9629621 | 9/1996 |

OTHER PUBLICATIONS

P.F. Goldsmith, "Quasioptical Systems: Gaussian Beam Quasioptical Propagation and Applications" Chpt. 9, p. 229–231, (1998), IEEE Press.

C. Antonopoulos, et al. "Multilayer frequency–selective surfaces for millimetre and submillimetre wave applications" *IEE Proc.Microw. Antennas Propag.*, vol. 144, No. 6, (1997).

Frenkel, A. "Thick Metal–Dielectric Window." Electronics Letters, IEE Stevenage, GB, vol. 37, No. 23 (2001) pp 1374–1375.

Arnaud,J.A., et al "Resonant–Grid Quasi–Optical Diplexers" The Bell System Technical Journal, vol. 54, No. 2 (1975) pp 263–283.

* cited by examiner

*Primary Examiner*—James Vannucci
(74) *Attorney, Agent, or Firm*—Ladas & Parry

(57) ABSTRACT

Ad device substantially transparent to electromagnetic radiation of a certain frequency band is presented. The device comprises at least one dielectric structure of a predetermined thickness defined by the central frequency of the operational frequency band of the device, and comprises a predetermined substantially periodic inner pattern inside the dielectric structure composed of a two-dimensional array of substantially identical sub-resonant capacitive elements made of an electrically conducting material and capable of scattering said electromagnetic radiation arranged in a disconnected from each other spaced-apart relationship.

37 Claims, 21 Drawing Sheets

ELECTROMAGNETIC WINDOW

FIELD OF THE INVENTION

This invention is generally in the field of electromagnetics, and relates to a device that presents an electromagnetic window allowing electromagnetic radiation of various frequencies to pass therethrough. The invention is particularly useful in radomes that cover antennas in the RF, microwaves, millimeter waves and sub-millimeter waves frequency bands; and in optical devices where the transmission of infrared, visible and ultraviolet frequency bands is required.

BACKGROUND OF THE INVENTION

Electromagnetic windows are usually designed to cover and protect a radiation source while maintaining high transmission of the radiation generated thereby, and are typically based on one or more planar or shaped dielectric layers. Electromagnetic windows can be divided into two groups: all-dielectric and metal-dielectric.

The all-dielectric windows are built from either a single dielectric layer or multiple dielectric layers, designed to maximize the transmission at specific frequency bands. U.S. Pat. No. 5,958,557 discloses an electromagnetic window having a single layer of half-wavelength thickness. This window is characterized by a rather narrow frequency-band due to its resonant character. At optical frequencies, the use of even thicker windows is proposed. These are multi-layer structures with various half-wavelength and quarter-wavelength sequences designed to filter the radiation and allow the transmission of only a specific frequency band.

In systems operating with radio and microwave frequencies, the use of an electrically thin window (of a thickness significantly smaller than a wavelength to be transmitted) enables to provide broadband low-loss transmission. This is achieved by one or more rigid-foam or honeycomb cores with two or more dielectric skins. This is disclosed, for example in U.S. Pat. Nos. 3,780,374 and 4,358,772.

Window-devices utilizing a metal-dielectric combination are of two types, In the first type, the added metal structure is aimed at improving or augmenting the window performance. U.S. Pat. No. 4,467,330 discloses the use of an inductive screen incorporated inside a solid dielectric window in order to tune the window for maximum transmission at a frequency for which the window has a thickness smaller than a half-wavelength. The inductive screen is a metal or metal-coated sheet of a connected or disconnected loop structure, thereby allowing the generation of induced closed current loops inside the window. The operation of such a metal-dielectric window is based on the cancellation of the capacitive loading of the dielectric layer against the inductive loading of the conducting loops.

The second metal-dielectric window type incorporates a transparent Frequency Selective Surface (FSS) inside the window. The transparent FSS is a metal or metal-coated sheet with a periodic array of resonant slots cut in the metal surface. Such a window may include several dielectric layers and one or more FSSs. The operation of this metal-dielectric window is based on the resonance phenomena of the slots. The resonance frequencies strongly depend on the geometry of the slot, which may be rectangular, shaped like a cross, Jerusalem cross, square ring, circular ring, etc. In addition to the resonant slots, this window may include also a conductive mesh or conductive elements to block radiation of certain frequency bands, different from the transmission band. This is disclosed, for example, in U.S. Pat. No. 4,785,310, GB 2337860 and EP 096529.

Controllable windows enabling to tune the transmission band of the window have been developed, and are disclosed, for example, in U.S. Pat. No. 5,600,325. Such windows utilize ferroelectric materials capable of changing their dielectric constant in response to the application of DC voltage thereto. The main problem with these devices is associated with the supply of DC voltage without destroying the window transparency. According to the technique of U.S. Pat. No. 5,600,325, the FSS has complete electrical conductivity, and therefore DC voltage can be directly applied to the FSS.

All the basic window types as described above (i.e., utilizing a single half-wave dielectric layer, a single dielectric layer thinner than a half-wave and inductively loaded, and a single frequency selective surface) can generate only a single reflection zero within the operation frequency-band.

SUMMARY OF THE INVENTION

There is a need in the art to facilitate the transmission of electromagnetic radiation by providing a novel broadband window device and method of its fabrication.

More specifically, the present invention provides broadband thick radomes, novel designs of sandwich radomes with thick skins, broadband windows for millimeter waves and sub-millimeter waves, new filtering windows for optical systems and new designs of electronically tunable windows.

The device of the present invention is a metal-dielectric window that utilizes a dielectric structure with inclusions in the form of an array of disconnected sub-resonant capacitive elements that tune the window/radome for transmission of a specific frequency band. The tuning of the window device for maximal transmission is such that complete matching is achieved at two frequencies for a single array of inclusions. The electrically conducting elements enable the tuning of the window by balancing the waves reflected from the dielectric discontinuities with the wave scattered from the conducting inclusions.

It should be understood that the term "sub-resonant element" signifies an element having a size such that the fundamental resonance frequency of the element is above the operational frequency band of the device (i.e., the frequency band to be transmitted). Actually, an attempt to operate at the resonance frequency of the element would result in the total reflection of the electromagnetic wave. Also, the term "capacitive element" signifies an element whose interaction with the electromagnetic wave does not generate closed-loop induced currents, the grid of the elements thereby presenting the so-called "capacitive grid" (see for example, Paul F. Goldsmith, Quasioptical Systems, IEEE Press 1998, pp. 229–231).

According to the present invention, the window device is tuned for transmission of a specific frequency band near the frequency of maximal reflection of the unloaded dielectric structure (with no inclusions). It should be understood that the term "maximal reflection" of the unloaded dielectric structure refers to the first maximum of reflection lying between the first and second transmission peaks (i.e., the first and second minimal reflections). Thus, according to the present invention, the control of the tuning is carried out by the inclusions, and the central frequency of a transmission band is controlled by the dielectric structure, while in the prior art devices of FSS radomes/Dichroic surfaces the central frequency is dictated by the resonant slots and the tuning is carried out by the dielectric layers. As indicated above, the single-layer based prior art devices of the kind specified (or single frequency selective surface based devices) can generate only a single reflection zero within the operation frequency-band. To achieve a reflection double-zero using the prior art techniques, one would need, for example, a window having three dielectric layers, or alternatively, a window having two frequency selective surfaces.

The term "dielectric structure" used herein signifies a single dielectric layer structure, or a symmetrical multi-layer structure formed by a stack of dielectric layers, that may be made of isotropic or anisotropic dielectric materials (i.e., the dielectric constant $\epsilon$ being a 3×3 symmetric tensor).

The thickness of the dielectric structure is dictated by the central frequency of the window device, i.e., the central frequency of the band to be transmitted by the device. The central frequency of the device is determined as approximately the mid-point of the first and second reflection minima of the unloaded dielectric structure. For example, for a single dielectric layer structure with thickness t, the first reflection minimum of the unloaded dielectric structure occurs at a frequency $f_1$ corresponding to $t/_{\lambda 1}=0.5$ ($_{80\ 1}$ being the wavelength of propagation of said radiation in the dielectric structure at frequency $f_1$), the second reflection minimum occurs at a frequency $f_2$ corresponding to $t/_{\lambda 2}=1$, the mid-point f thus being: $f=(f_1+f_2)/2$ corresponding to $t/_{\lambda}=0.75$. Thus, for a single dielectric layer structure, its thickness is preferably about $0.75_{\lambda}$, considering the central frequency of the window device. It should be understood that in the case of a multiple dielectric layer structure, there is no single wavelength that characterizes the radiation propagation in the entire structure, the wavelength of propagation varying from layer to layer and being the smallest in the layer of the highest dielectric constant at all the frequencies of incident radiation. Hence, the thickness of such a multiple dielectric layer structure cannot be defined in terms of wavelengths, but rather derived from the mid-point frequency between the first and second reflection minima.

It should be understood that for the purposes of the present invention, the scattering disconnected elements are made of an electrically conductive material. In most cases, such elements are metallic (made of a metal containing material), but other conducting materials, such as superconductors or conducting polymers, can be used as well. The array of these elements is substantially periodic, namely, may be periodic or quasi-periodic signifying that the average density of the spaced-apart elements forming the pattern is approximately the same all along a pattern-containing area. The periodicity type of the array can be a rectangular grid, a hexagonal grid or any other type of two-dimensional periodic grid.

There is thus provided according to one broad aspect of the present invention, a device substantially transparent to electromagnetic radiation of a certain frequency band, the device comprising at least one dielectric structure of a predetermined thickness defined by the central frequency of said certain frequency band, and a predetermined substantially periodic pattern inside said at least one dielectric structure, the inner pattern being formed by a two-dimensional array of spaced-apart substantially identical capacitive sub-resonant elements, which are disconnected from each other and are made of an electrically conducting material capable of scattering the electromagnetic radiation.

The thickness of the dielectric structure is selected such that for the unloaded dielectric structure made from given dielectric materials (with given dielectric constants), the first and second reflection minima (substantially zero reflections) are observed, a mid point between these two minima being intended for the central frequency of a frequency band to be transmitted by the dielectric structure with inclusions. For a single layer window, the thickness of the dielectric structure is preferably of about $0.75_{\lambda}$, wherein $_{\lambda}$ is the maximal wavelength of propagation of said radiation in the dielectric structure.

The present invention provides for using a symmetric multi-layer window (e.g., a conventional A-type radome with a core and two skins, or a C-type radome with two cores and three skins) with the substantially periodic array of inclusions as defined above located at the central plane of the window to thereby interfere destructively with the reflections from dielectric interfaces.

Owing to the fact that the elements are small in size relative to the wavelength (or wavelengths) of the radiation propagating in the dielectric structure, no self-resonance of the individual inclusion is excited within the frequency band to be transmitted. The dimensions of the radiation scattering elements and spaces between them are chosen such that the scattering from the elements compensates for the reflection from the dielectric discontinuities (e.g., the air-dielectric interfaces), thereby causing the formation of a double-resonance transmission band. More specifically, in the case of a single dielectric layer, the two transmission peaks of the unloaded window at frequencies related to the half-wavelength and one-wavelength of the electromagnetic radiation are both brought close to the three-quarter-wavelength point, and generate together a deep and wide transmission band. For example, a typical bandwidth at the −20 dB level is 5 times wider than that of the conventional half-wavelength window.

According to another aspect of the present invention, there is provided a radiation source for generating electromagnetic radiation of a certain frequency band utilizing the above-described window device for transmitting at least a predetermined frequency range of said certain frequency band of the generated radiation.

The metal-dielectric based window device of the invention can be a passive device, or an electrically controllable device.

According to yet another aspect of the present invention, there is provided a method for constructing the above-described window device to be substantially transparent to electromagnetic radiation of the certain frequency band, the method comprising: fabricating at least one dielectric structure made from at least one dielectric material of a predetermined dielectric constant and having a predetermined thickness defined by the central frequency of the window device and, fabricating an inner pattern inside said at least one dielectric structure in the form of a two-dimensional array of substantially identical sub-resonant capacitive electrically conductive scattering elements arranged in a disconnected spaced-apart relationship, the dimensions of the electrically conductive scattering elements and the spaces between them being selected so as to ensure that the scattering from said elements compensates for reflection effects from the dielectric discontinuities.

The array of conductive elements is preferably positioned in a plane located at the middle of the dielectric structure thickness, parallel to the planes defined by upper and lower surfaces of the dielectric structure. The present invention allows for using a planar or shaped window device, with a constant thickness all along the window, as well as a device of varying window thickness.

The conductive elements of various shapes can be used, such as voluminous elements (e.g., spheres, cylinders, boxes) or substantially flat elements (e.g., circular or rectangular patches). Such electrically conductive inclusions may be formed by coating conductive elements with one or more dielectric layers, coating dielectric elements by at least one conducting layer, conductive coating of through-holes, or selective conductive coating of honeycomb cores.

The device according to the invention may include, in addition to the array of inclusions, also parallel strips made of a highly reflective or scattering material (e.g., electrically conductive material). This makes the device reflective to electromagnetic radiation polarized in a direction parallel to the longitudinal axes of strips, while maintaining the desired transmission for radiation polarized in a direction perpendicular to the strips' axes. Hence, when using the device with a linearly polarized radiation source, various configurations of parallel conducting strips can be used.

The device may also utilize thin layers of ferroelectric materials of very high dielectric constant controlled by an external voltage source (in a symmetrical position relative to the layer(s) of metal objects). This allows a gradual change of the average dielectric constant, and the dynamic shift of the location of the pass-band according to the applied voltage. The above-indicated strips made of an electrically conductive material may be used, being printed on one or two sides of these ferroelectric layers to thereby enable application of a DC voltage to the ferroelectric layers.

The window structure according to the invention is mildly dependent on the angle of incidence at angles up to 60 degrees, for both parallel and perpendicular polarizations. Hence, the device is characterized by improved transmission, as compared to that of the conventional half-wavelength window. This effect is achieved by controlling both the array grid parameters and the size of the conductive inclusions. The use of different combinations of grid parameters and inclusions' size result in the same transmission curve at normal incidence, while differing appreciably in oblique incidence transmission (i.e., the denser the grid, the milder the effects of oblique incidence).

The device according to the invention may be a multi-stage structure, where dielectric structures, each with the two-dimensional array of metal-containing inclusions, are placed on top of each other. Several structures constructed as described above can be combined to generate a thick multi-stage window structure with very sharp transitions at the frequency edges of the transmission band, at the expense of higher transmission loss.

The performance of the multi-stage structure may be improved by varying the layers' thicknesses (in a symmetric layer structure) and dimensions of the conducting solids, wherein the transmission response curve is tuned as a function of frequency. The stages (each in the form of the above-described structure) can be shifted laterally by half the grid constants to generate new three-dimensional grids out of the same two-dimensional grids.

Moreover, with high dielectric constant material, the multi-stage window leads to almost complete blockage of two frequency bands below and above the transmission band. Alternatively, two stages can be combined with a low dielectric spacer between them to generate a wideband window with a bandwidth of almost an octave.

According to yet another aspect of the present invention, there is provided a tunable device for transmitting electromagnetic radiation of a certain frequency band, the device comprising:

at least one dielectric structure of a predetermined thickness defined by the central frequency of the device;

an inner pattern formed by inclusions inside said at least one dielectric structure, the pattern being in the form of a two-dimensional array of substantially identical electrically conductive sub-resonant capacitive elements capable of scattering said electromagnetic radiation, said elements being arranged in a disconnected from each other spaced-apart relationship; and at least two ferroelectric layers located at opposite sides of said at least one dielectric structure, the application of an electric field to said ferroelectric layer effecting a change in a dielectric constant of said ferroelectric layer.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
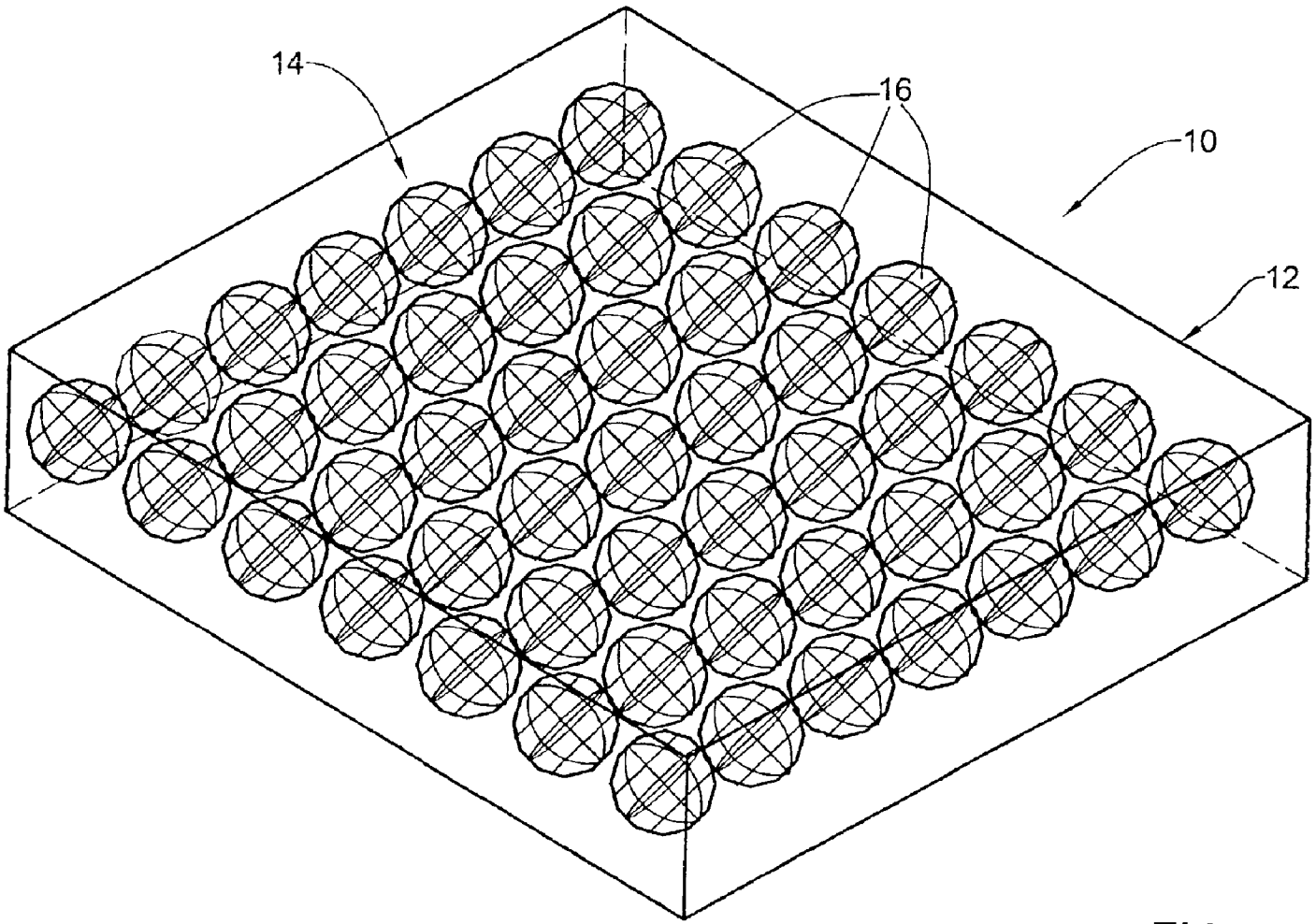
FIG. 1 is a schematic illustration of a device according to the present invention formed by a dielectric structure with metal-containing inclusions.

Referring to FIG. 1, there is illustrated a device 10 according to the invention, presenting a single layer window for transmitting therethrough electromagnetic radiation of the wavelength $_{\lambda 0}$ (or a wavelength band with the central wavelength $_{\lambda 0}$). The device 10 comprises a dielectric structure 12 (single dielectric layer slab in the present example) and an inner two-dimensional periodic pattern 14 (grid) located inside the slab defining a patterned area. The pattern 14 is formed by sub-resonant capacitive metal inclusions 16 (constituting elements capable of scattering incident radiation), which are aligned in a disconnected from each other spaced-apart relationship with a grid constant a in a central plane of the slab 12. In the present example, such inclusions are spheres with a radius r.

It should be noted that the inclusions can be made of metal elements, metal-coated dielectric elements, or dielectric-coated metal element. In cases where the inclusions are closely packed, the use of dielectric coating enables to avoid any direct contact of the conducting elements. Other realization of the conducting inclusions could be metal-coated through-holes in a dielectric slab, thus avoiding the necessity to implant solid inclusions. These metal-coated through-holes scatter effectively the incident radiation even if the through-hole is hollow. Yet another realization of the conducting inclusions is a selective metal coating of a dielectric honeycomb structure, where the selectivity of metal coating means that the coating is not necessarily applied to all the holes in the honeycomb, and that the metal coating may cover only a central portion of the hole.

Considering the thickness d of the dielectric slab 12, relative permittivity $_{\epsilon r}$ of the dielectric material, and relative permeability $_{\mu r}$ radiated by normally incident electromagnetic radiation of the wavelength $_{\lambda 0}$ in vacuum, the wavelength $_{\lambda}$ of the radiation propagation inside the slab is as follows: $_{\lambda}=_{\lambda 0}/\mathrm{sqrt}(_{\in r \mu r})$. It is known that for such a slab to be transparent for this radiation, it either should be much thinner than the wavelength $_{\lambda}$ of radiation propagation (i.e., $d<<_{\lambda}$), or should have a resonant thickness of one or more half-wavelengths (i.e., $d=n_{\lambda}/2$, n being an integer). It is evident that the resonant transmission bandwidth is narrow, especially for dielectric materials with high values of relative permittivity $_{\in r}$. In the device 10, the thickness of the dielectric layer 12 is of about $0.75_{\lambda}$. Generally, the thickness of the dielectric slab is selected such that the unloaded slab (with no inclusions) has maximum reflection at about the central frequency of operation, namely, has first and second reflection minima such that a mid point between them (frequency of maximal reflection) will be the central frequency of the window device with inclusions.

Figure 2A:
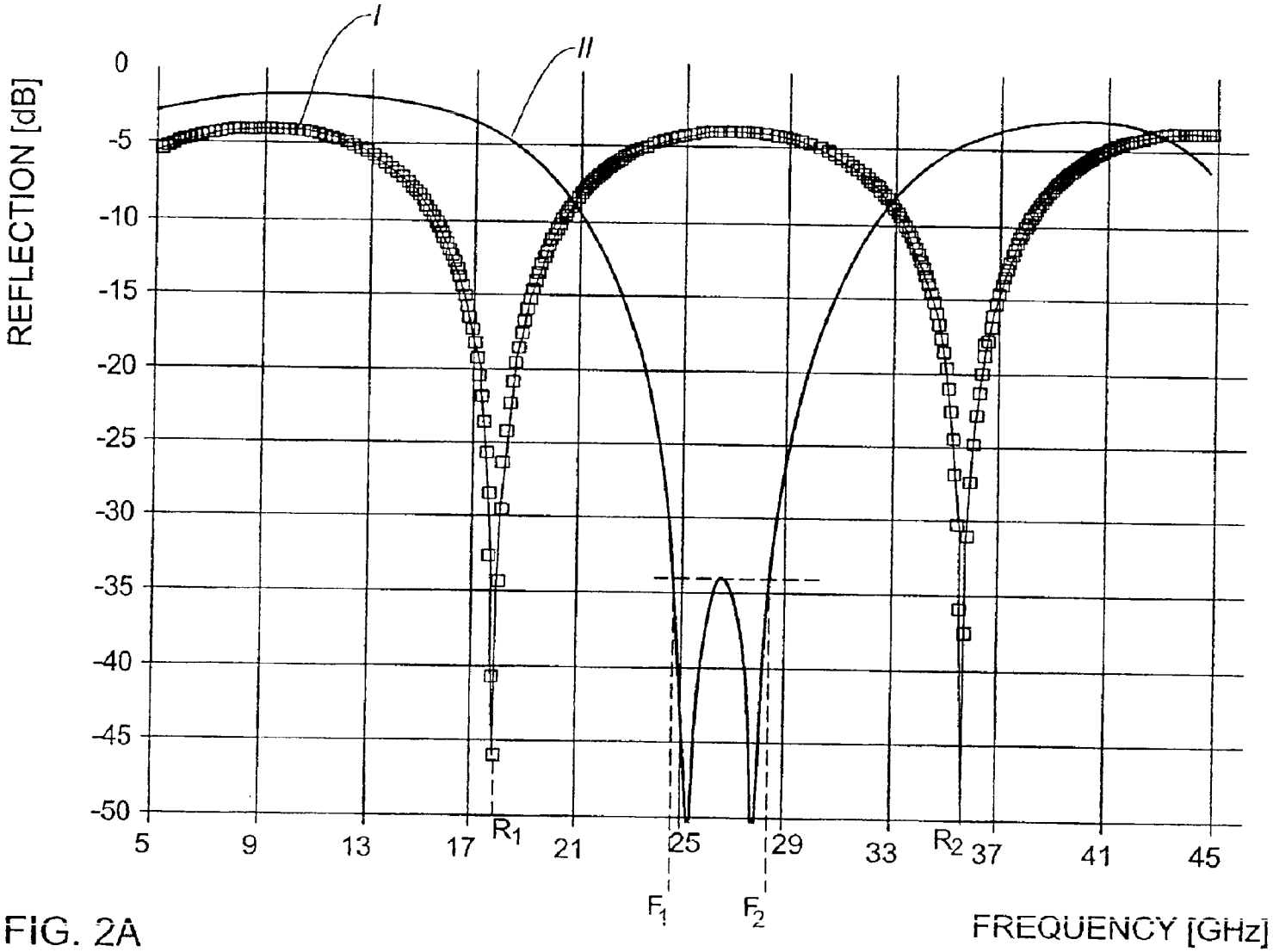
FIG. 2A illustrates the reflection coefficient as a function of frequency for, respectively, the unloaded dielectric structure of the device of FIG. 1 and the dielectric structure with the inclusions.

FIG. 2A illustrates two graphs I and II presenting the reflection coefficient R as a function of frequency for, respectively, the unloaded dielectric structure 12 and the device 10 (structure 12 with inclusions 16). In the present example, the dielectric structure is made of a material with a dielectric constant $_{\in}$=4.4 and has a 4 mm thickness. As shown, the unloaded dielectric structure is characterized by the first and second reflection minima (substantially zero reflections) $R_1$ and $R_2$, while loading of this structure with the sub-resonant capacitive disconnected inclusions results in a transmission frequency band $F_1$–$F_2$ centered at the mid point between the two reflection minima $R_1$ and $R_2$.

Generally, the reflection coefficient R measures the ratio between the amplitudes of reflected and incident waves, and the transmission coefficient T measures the ratio between the amplitudes of the transmitted and incident waves. These ratios are complex numbers determined as follows:

$$R=|R|\cdot e^{i\phi r}$$

$$T=|T|e^{i\phi t}$$

wherein |R| is the ratio between the amplitudes of the reflected and incident plane waves; |T| is the ratio between the amplitudes of the transmitted and incident plane waves; $_{\phi r}$ and $_{\phi t}$ are phase delays of, respectively, the reflected and transmitted plane waves, relative to the incident plane wave, and are defined as follows. $-_{\phi}=_{\omega}\cdot t_{delay}$ ($_{\omega}=2_{\pi}f$, f being the frequency of the incident radiation).

Figure 2B:
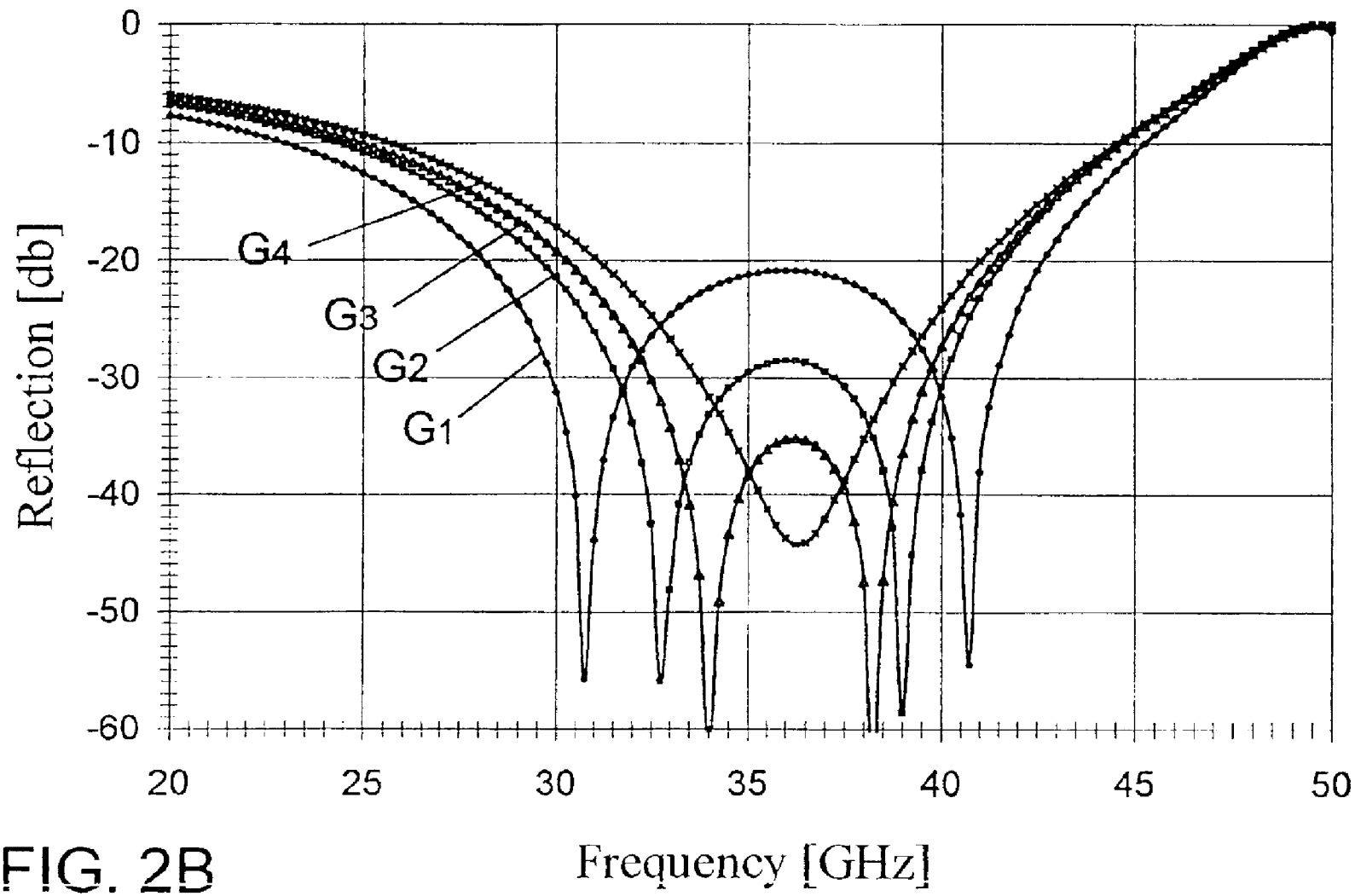
FIG. 2B illustrates simulation results showing the dependency of the frequency variations of the reflection coefficient of the device of FIG. 1 on the radius of sphere inclusions.

Reference is made to FIG. 2B, illustrating simulation results of variations of the reflection coefficient with the frequency of the electromagnetic radiation for normal incidence onto the window device 10. In this specific example of FIG. 2B, the following parameters of the window device are used: d=4 mm, $_{\in r}$=2.2, and a=4 mm. Different graphs $G_1$, $G_2$, $G_3$ and $G_4$ correspond, respectively, to different values of the spheres' radius $r_1$=0.88 mm, $r_2$=0.96 mm, $r_3$=1 mm and $r_4$=1.04 mm. As shown, enlarging the spheres' radius r results in that $_{\lambda}/2$- and $_{\lambda}$-resonance curves couple, the lower resonance moves up in frequency, and the upper resonance moves down in frequency, with the level of reflection at the central frequency lowering dramatically. At the radius value $r_4$ (critical value), the two resonances coalesce, and a single dip is obtained. Enlarging the radius r beyond the critical value causes an increase of the reflection, and fills in the transmission band. In this specific example, the fundamental resonance of the spheres occurs at 49.7 GHz. This is a peak of total reflection (0 dB reflection coefficient), which characterizes all grids of resonating conducting objects.

The above performance of the single layer window device 10 is based on the interference of three scattering processes occurring in the device during the propagation of the electromagnetic radiation therethrough:

(1) reflection of the radiation from the first air-dielectric interface (defined by the upper surface of the dielectric layer), (2) reflection of the radiation from the second air dielectric interface (defined by the lower surface of the dielectric layer), and (3) radiation scattering from the array of metal inclusions.

Figure 3:
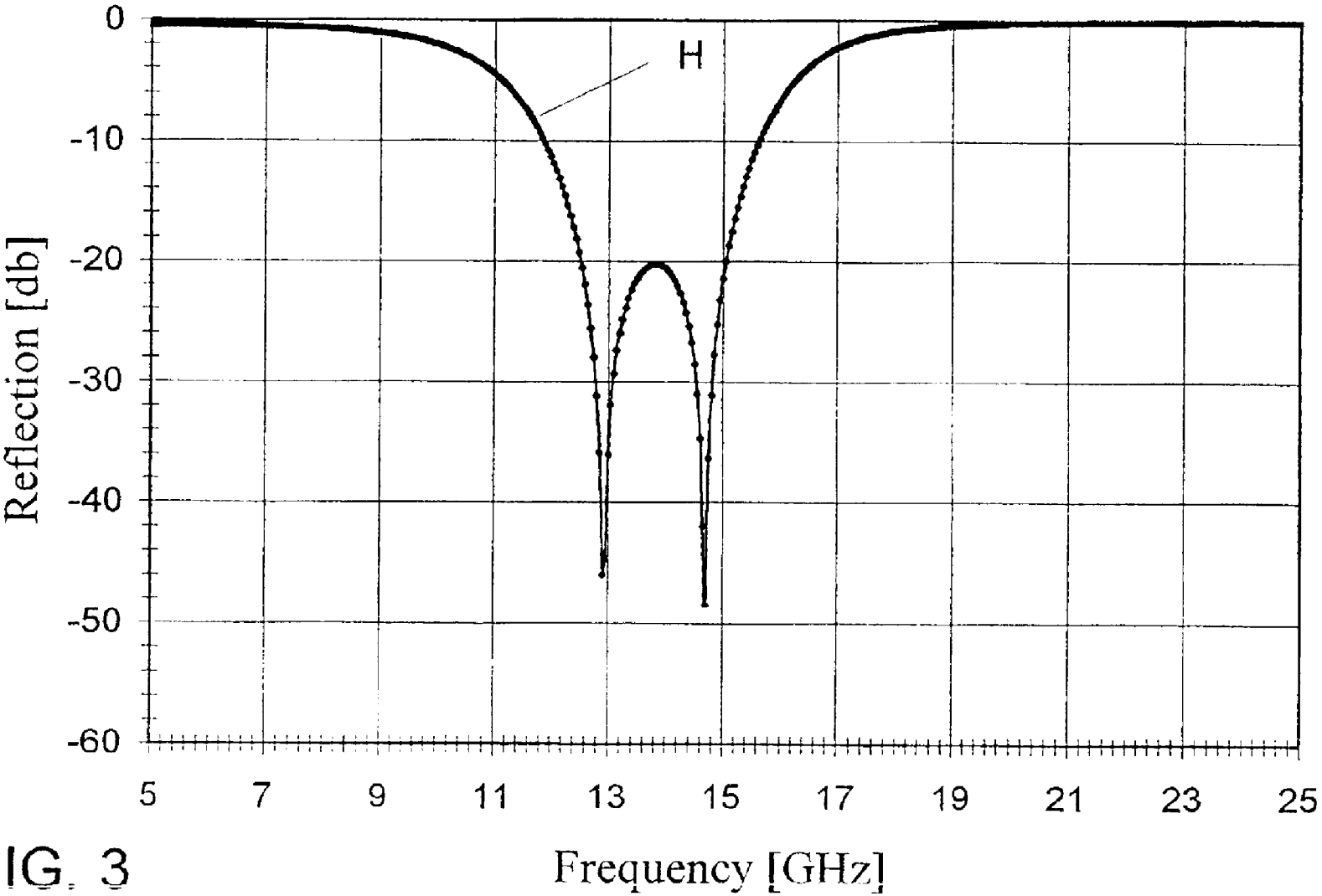
FIG. 3 illustrates the reflection coefficient as a function of frequency for a specific example of the single layer device according to the invention with high relative permittivity of a dielectric layer.

FIG. 3 illustrates a graph H presenting the reflection coefficient at normal incidence of the electromagnetic radiation as a function of frequency, for a specific example of the single layer device with the following parameters: $\in_r$=13.2, d=4 mm, a=1 mm, and r=0.48 mm. Considering the transmission band as the ratio between the frequency difference of the (−20)dB reflection points and the central frequency, it is shown that with a larger value of dielectric constant (13.2 compared to 2.2 of the example of FIG. 2), sharpening of the transmission band is observed. The simulation results have shown that the transmission bands of 35%, 23%, 20.5% and 18% can be obtained with the relative permittivity values 2.2; 4.4; 8.8 and 13.2, respectively.

Figure 4:
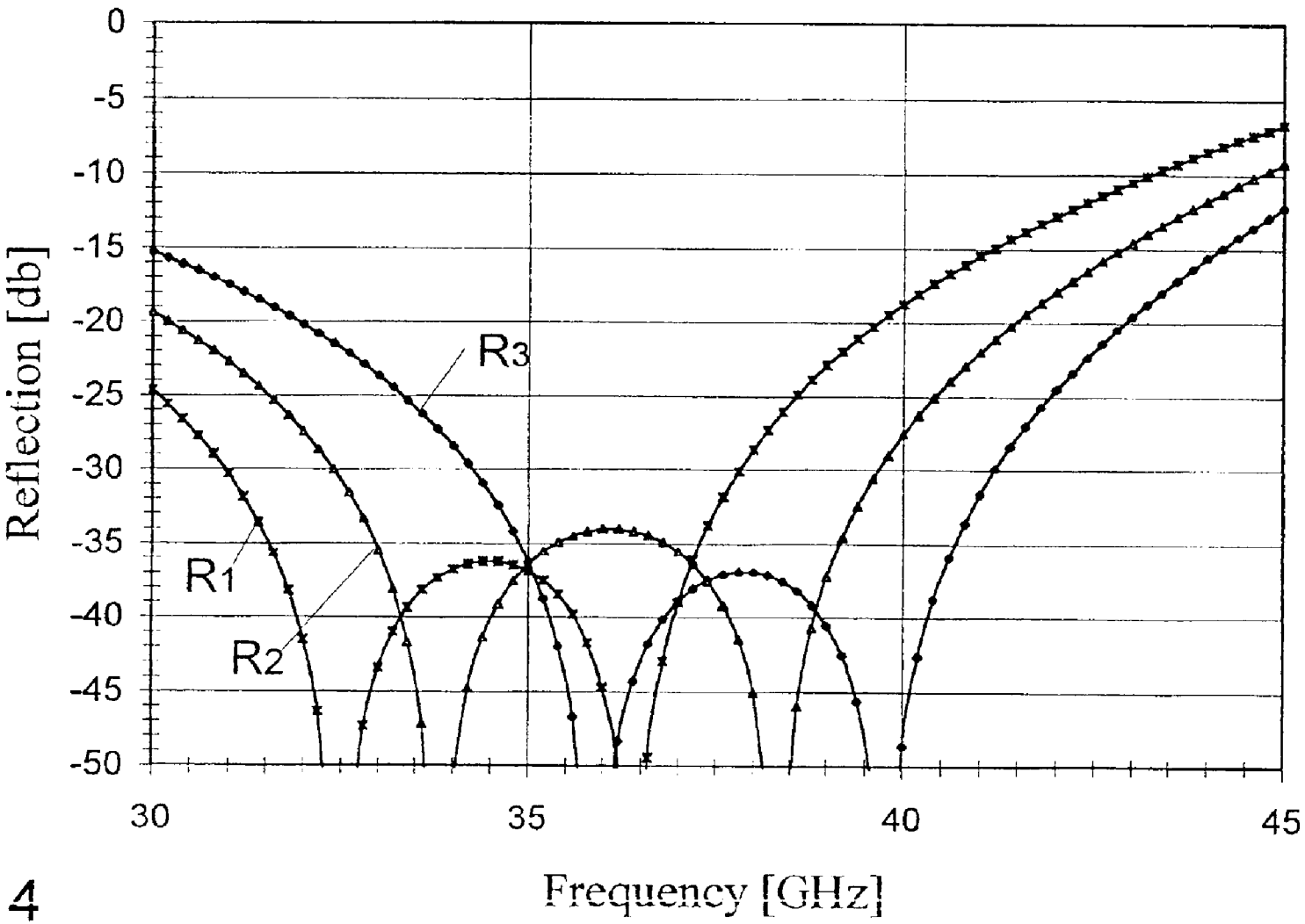
FIG. 4 illustrates simulation results showing how the change in the dielectric layer thickness affects the center frequency of the transmission band.

The transmission window of the present invention can be easily shifted in frequency by slightly modifying the thickness d of the dielectric slab (12 in FIG. 1) without changing the radius and grid constant values r and a. This is illustrated in FIG. 4 showing similar graphs $R_1$, $R_2$ and $R_3$ for a specific example of $\in_r$=2.2, a=4 mm, r=1 mm, and the thickness values $d_1$=4.2 mm, $d_2$=4 mm and $d_3$=3.8 mm, respectively. As shown, the change in the dielectric layer thickness affects the frequency of the transmission band, while substantially not affecting the level of reflection inside the transmission band.

Figure 5:
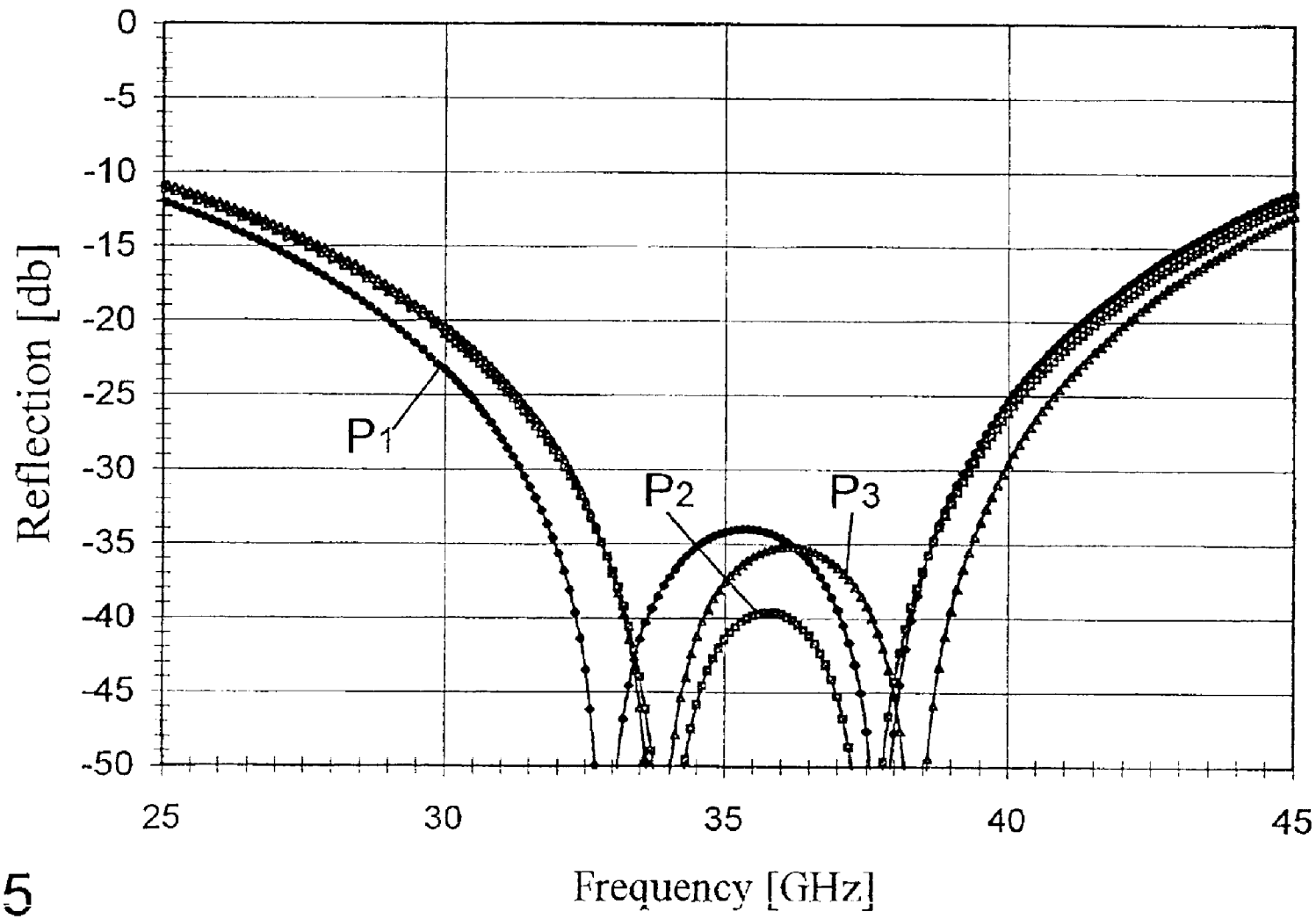
FIG. 5 illustrates simulation results showing how the scattering from the metal inclusions, defined by the dimension of the inclusion and the grid constant, affect the device performance.

For a specific dielectric slab (with certain values of thickness d and relative permittivity $\in_r$), different transparent windows can be constructed by controlling the scattering from the metal-containing inclusions, namely selecting the sphere radius r (generally, the dimension of the inclusion) and the grid constant a. For example, a dielectric slab with the thickness d=4 mm and relative permittivity $\in_r$=2.2 is used, the grid constant a is changed and the sphere radius r is optimized for each grid constant to obtain a transmission frequency band. This is illustrated in FIG. 5 showing three graphs $P_1$, $P_2$ and $P_3$ corresponding, respectively, to the following grid and radius values: $a_1$=1 mm, $r_1$=0.33 mm; $a_2$=2 mm, $r_2$=0.56 mm, and $a_3$=3 mm, $r_3$=0.77 mm. Almost identical transmission windows are obtained for these three different implementations. The optimum radius decreases monotonically with the grid constant a. Simulation results have shown that the equivalence between the above-described different implementations is not only in the reflected/transmitted amplitude, but also in the reflected/transmitted phase.

Figure 6:
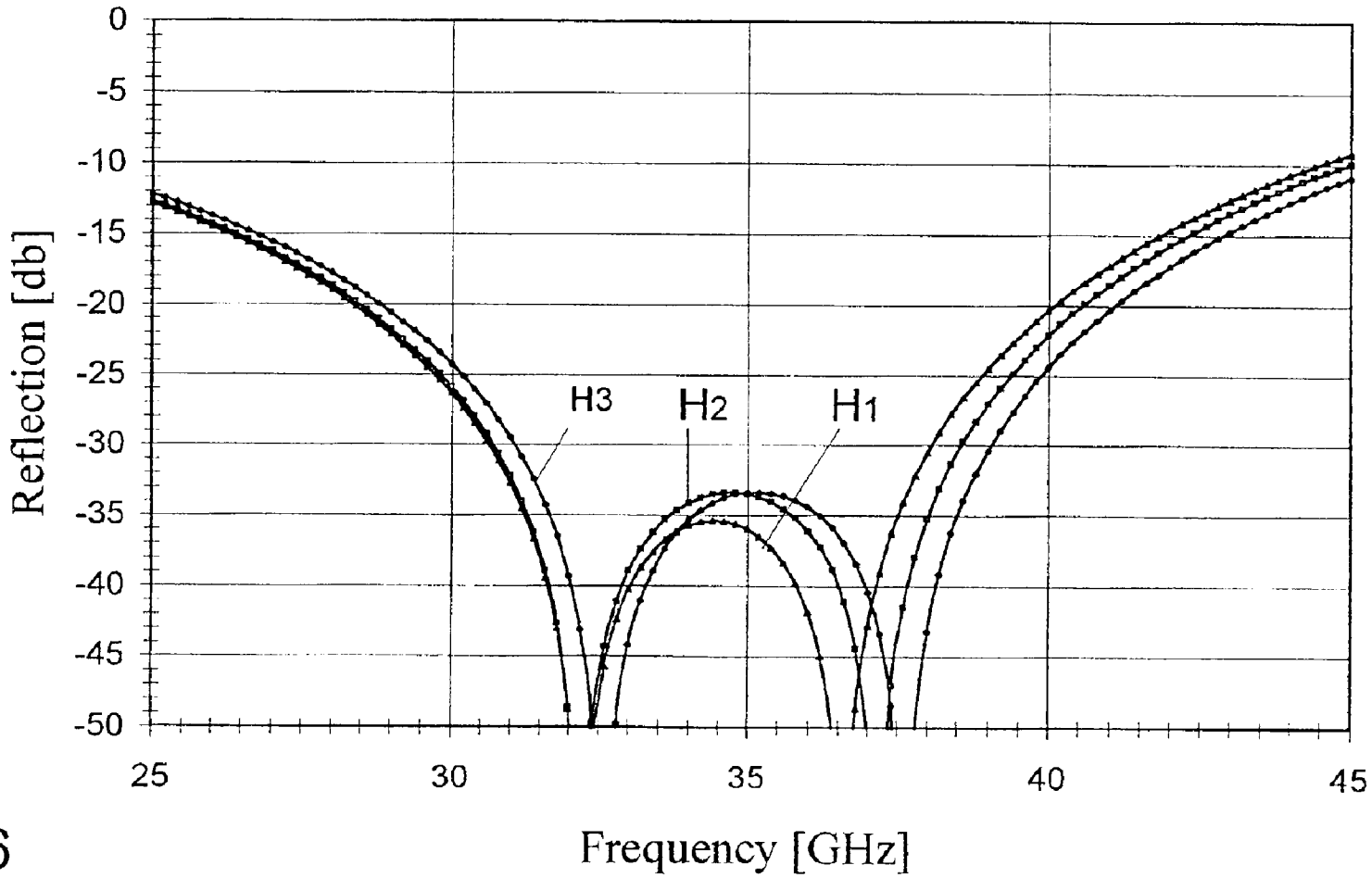
FIG. 6 illustrates the reflection coefficients as functions of frequency at normal incidence for a specific example of the device according to the invention.

The inclusions 16 in FIG. 1 may be cylinders or boxes. FIG. 6 illustrates the reflection coefficients at normal incidence as functions of frequency for three specific examples of a dielectric structure with cylindrically shaped inclusions with the following common parameters for all three examples: $\in_r$=2.2, d=4 mm, a=1.5 mm. Three graphs $H_1$, $H_2$ and $H_3$ correspond, respectively, to the following values of height h and radius r of the cylinders: $r_1$=0.48 mm, $h_1$=0.27 mm; $r_2$=0.45 mm, $h_2$=0.35 mm; and $r_3$=0.42 mm, $h_3$=0.5 mm. As shown, substantially the same transparent frequency band is obtained.

It is important to note that contrary to the use of an inductive grid (e.g. metal mesh or an array of conducting loops) to tune windows of thickness smaller than $\lambda/2$, the metal inclusions of the present invention are separated from each other and are of the capacitive kind, i.e., do not allow large current loops to occur. Moreover, if the inclusions in the array were connected (e.g., by short wire segments) to generate a connected mesh, the window would not be transparent any more.

In the example of FIG. 1, the periodic grid of the metal inclusions is square. It should, however, be noted that, for the purposes of the present invention, the grid may be rectangular, triangular or hexagonal, as well. Generally, for each grid type and constants, a different size of inclusions needs to be selected to obtain the desired transparent window.

The following should be noted: Enlarging the grid constant beyond $\lambda/2$, generates grating lobes inside the dielectric slab and can result in undesirable reflection. Reducing the grid constant to less than $\lambda/20$, the inclusions may intersect with each other prior to obtaining the optimal point of low reflection level. In the example of FIG. 5, the smallest grid spacing that could be used with non-touching conducting balls to obtain an optimized transparent window would be a=0.28 mm.

Figure 7:
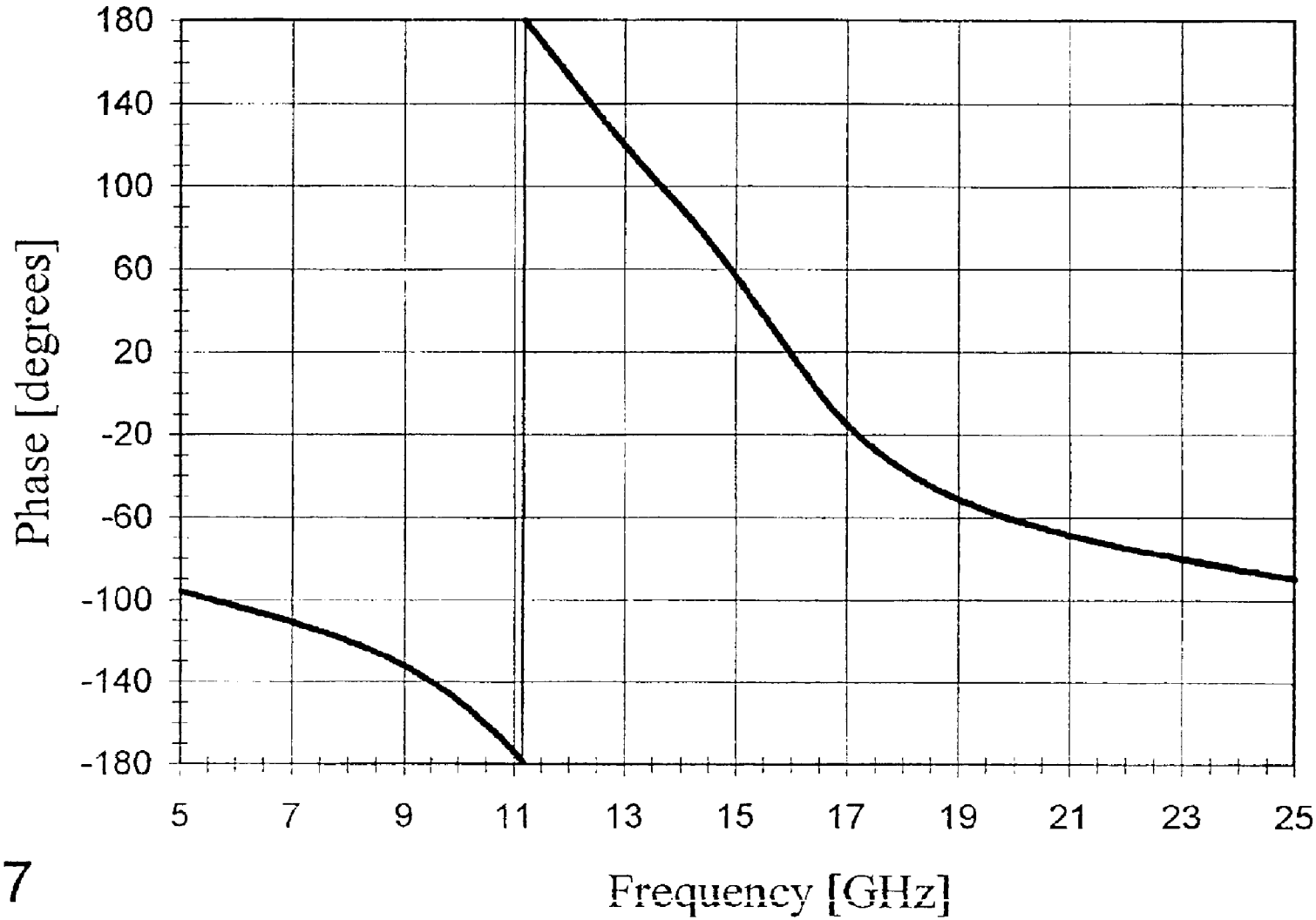
FIG. 7 illustrates frequency dependence of the phase delay generated by a single layer window device according to a specific example of the invention.

Turning now to FIG. 7, there is shown that the phase delay generated by the single layer transparent window of the present invention has linear frequency dependence inside the transmission band. In the present example, the phase of the wave transmitted by the window of FIG. 3 ($\in_r$=13.2, d=4 mm, a=1 mm, and r=0.48 mm) is presented.

Comparing the effective optical thickness L of the window (as calculated from the phase delay, which is equal to $2_\pi L/_\lambda$) with the thickness d of the dielectric slab, the effective optical thickness of the window device of the present invention is larger. Depending on the dielectric constant and thickness of the dielectric layer, and the grid constant of the inclusions' array, the increase of 15–80% in the effective optical thickness has been observed in various examples. The larger delay of the wave inside the window device according to the invention, which is presumably because of the multiple scattering with the inclusions, provides an important design parameter for both microwaves and optical designs.

With regard to the periodicity of the array of inclusions, the following should be understood. Although a perfect periodic array of metal inclusions has been assumed so far, only quasi-periodicity is important, i.e., a short-range order and not a long-range order.

Figure 8A:
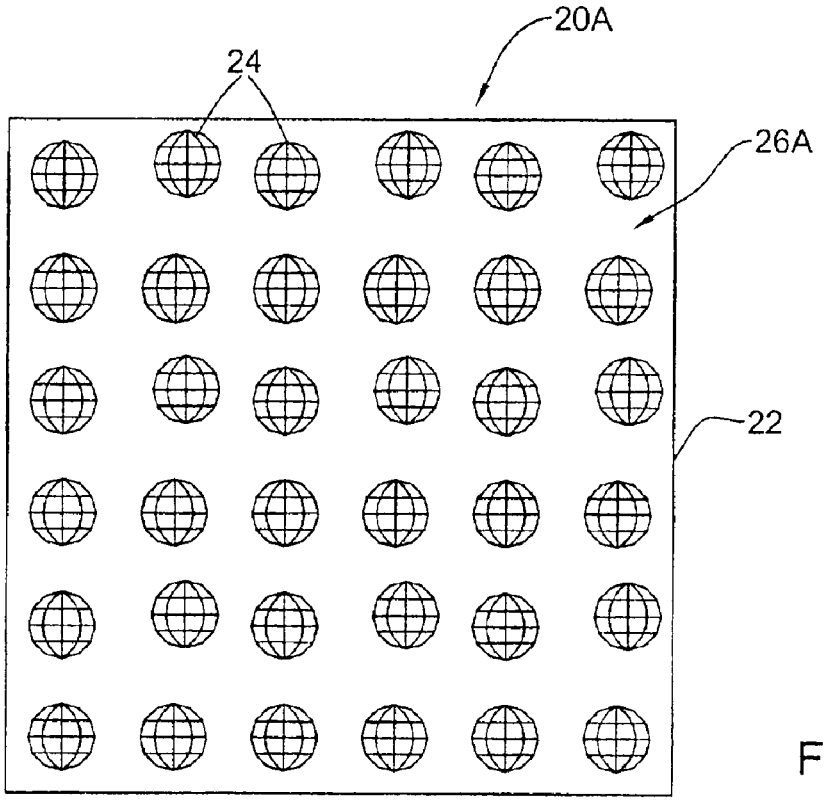
FIGS. 8A and 8B illustrate window devices according to two different examples, respectively, according to the invention, with the inner patterns being obtained by shifting some of the electrically conductive elements from positions in a two-dimensional array with ideal periodicity.
Figure 8B:
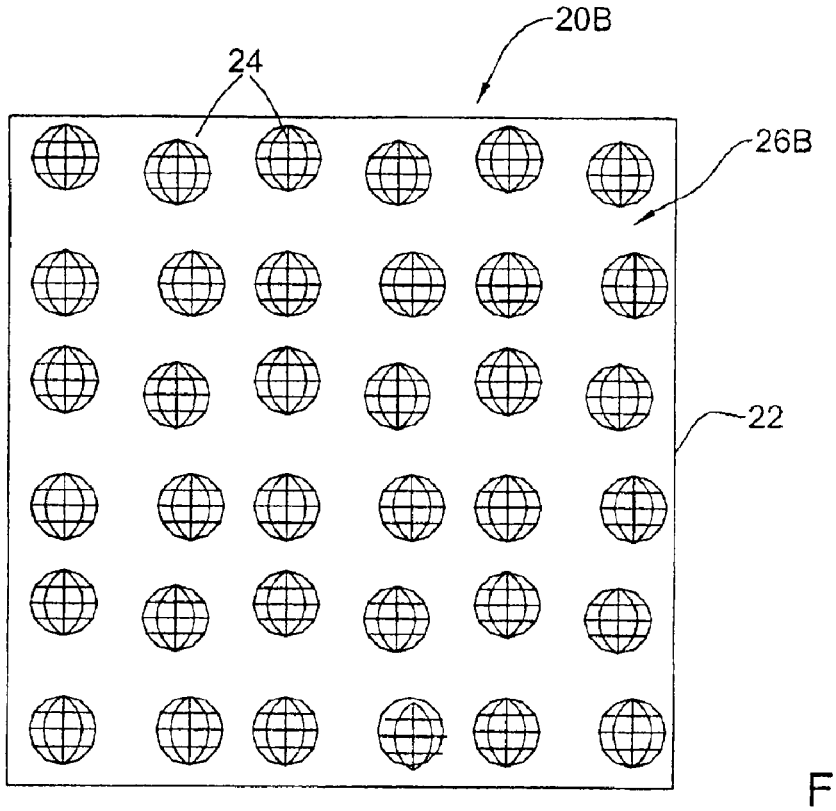

FIGS. 8A and 8B illustrate two devices 20A and 20B, respectively, both with the thickness d=4 mm and relative permittivity $e_r$=2.2 of a dielectric slab 22, and with the 1.5 mm grid constant of a quasi-periodic array of spheres 24 (inclusions). Array 26A of the device 20A is obtained by shifting about 25% of the entire number of spheres of an ideal (periodic) array a distance $1.414_\delta$ diagonally off the center of their unit-cell. Array 26B of the device 20B is formed by shifting 25% of the entire number of spheres of an ideal array a distance $_\delta$ along the X-axis, and sifting 25% of spheres the distance $_\delta$ along the Y-axis.

Figure 9:
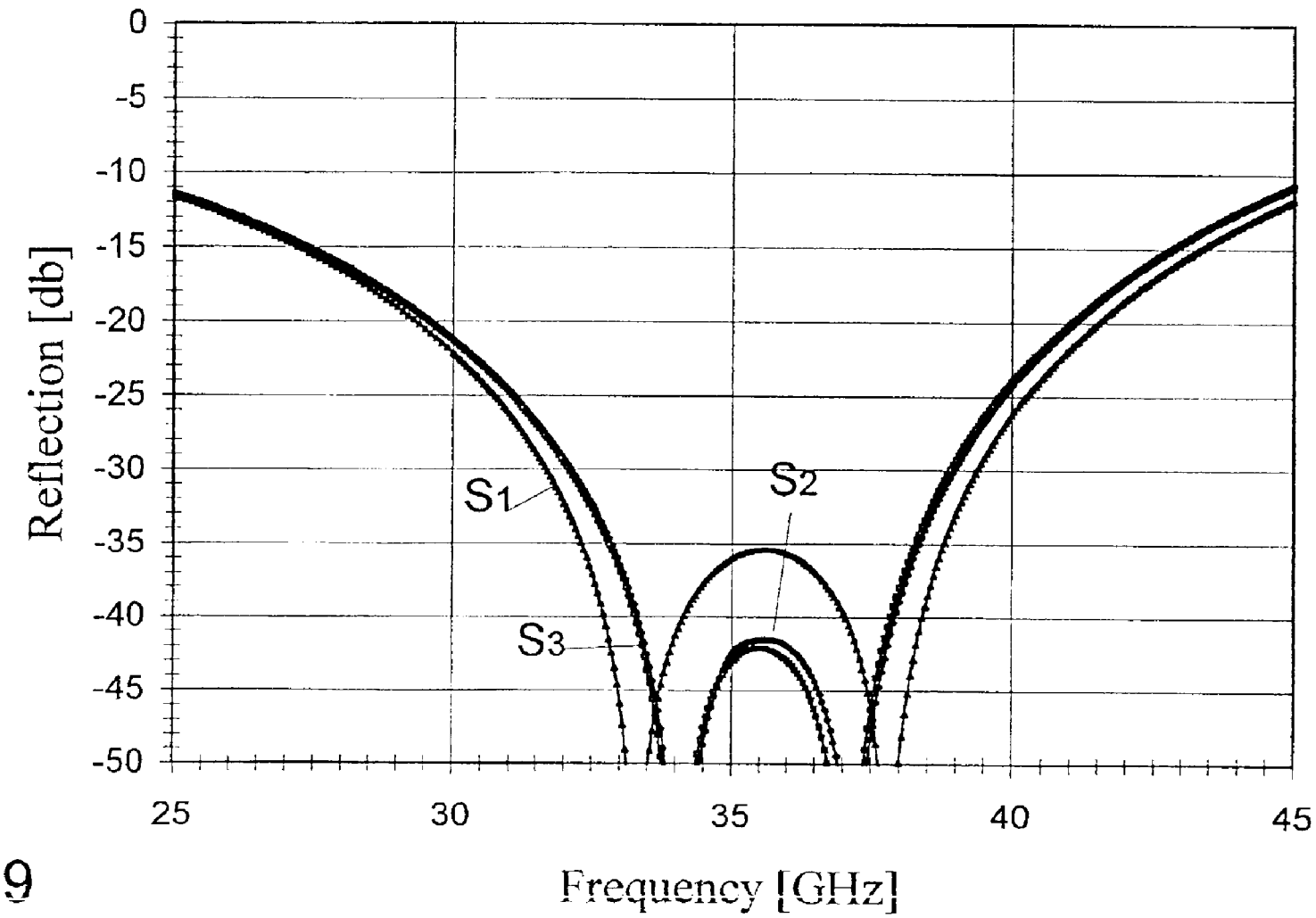
FIG. 9 illustrates variations of the reflection coefficient with the frequency of electromagnetic radiation for a window device with the ideal array, and the devices of FIGS. 8A and 8B.

FIG. 9 illustrates the variations of the reflection coefficient with the frequency of electromagnetic radiation, wherein three graphs $S_1$, $S_2$ and $S_3$ correspond to, respectively, a window device with the ideal array, the window device 20A, and the window device 20B. As shown, the reflection coefficient of these windows confirms the sufficiency of the quasi-periodicity of the arrays.

Another important aspect of the performance of a window device is associated with dependency of the reflection coefficient on the angle of incidence and on the polarization of the electromagnetic radiation. A solid window with a $\lambda/2$-thickness has a rather poor performance in this regard.

Considering the above-described simulation results of FIG. 5 and the equivalence in the reflected/transmitted phase of the different grid implementations, the following results would be expected: the lower the grid constant, the lower the sensitivity of the window to oblique incidence.

The performance of the window with $\epsilon_r$=2.2, d=4 mm, a=1.5 mm and r=0.45 mm has been investigated for oblique incidence within a range of incident angles θ up to 60 degrees to the Z-axis, and for both linear polarizations of the incident radiation (parallel and perpendicular to the plane of incidence).

Figure 10:
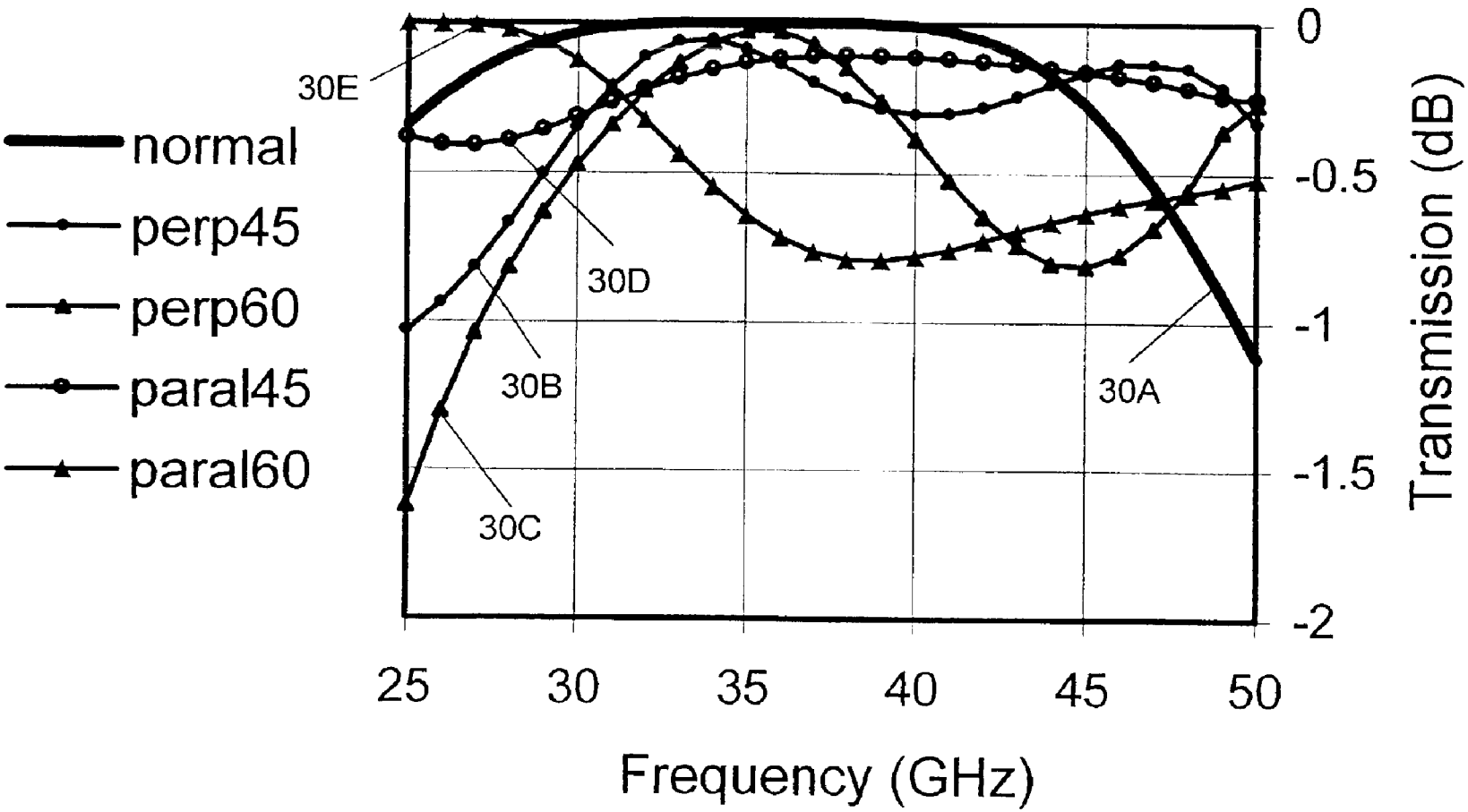
FIG. 10 illustrates the transmission of the window device of the present invention as a function of frequency for five different incidence directions and polarizations of the incident wave, respectively.

FIG. 10 illustrates five graphs 30A–30D presenting the device transmission as a function of frequency for, respectively, the following examples of radiation incidence onto the device: graph 30A—normal incidence; graph 30B—radiation polarized perpendicular to the incident plane and impinging onto the window at a 45° angle of incidence; graph 30C—radiation polarized parallel to the incident plane and impinging onto the window at a 60° angle of incidence; graph 30D—radiation polarized parallel to the incident plane and impinging onto the window at a 45° angle of incidence; and graph 30E—radiation polarized parallel to the incident plane and impinging onto the window at a 60° angle of incidence. The graphs show that the window device mildly shifts in frequency with variations in the angle of incidence and polarization of the incident radiation.

A window device of the present invention may comprise multiple dielectric layers (constituting a dielectric structure) and a single array of metallic inclusions. The additional layers are either part of the basic design of the window due to, say, mechanical demands, or result from such manufacturing processes as coating, painting, glazing or impregnation. According to the present invention, the geometry of the metal inclusions can be re-tuned (selected) to account for these external dielectric layers.

The most popular window structures are multi-layer all-dielectric windows like an optical window with two tuning layers of a $\lambda$/4-thickness, or an A-type composite radome with one core layer (inclusions containing layer) and two external skin layers (dielectric layers without metal inclusions). A device according to the present invention may include a symmetric multi-dielectric layer structure with a single array of metallic (generally, conductive) inclusions at the center of the multi-dielectric structure.

Figure 11:
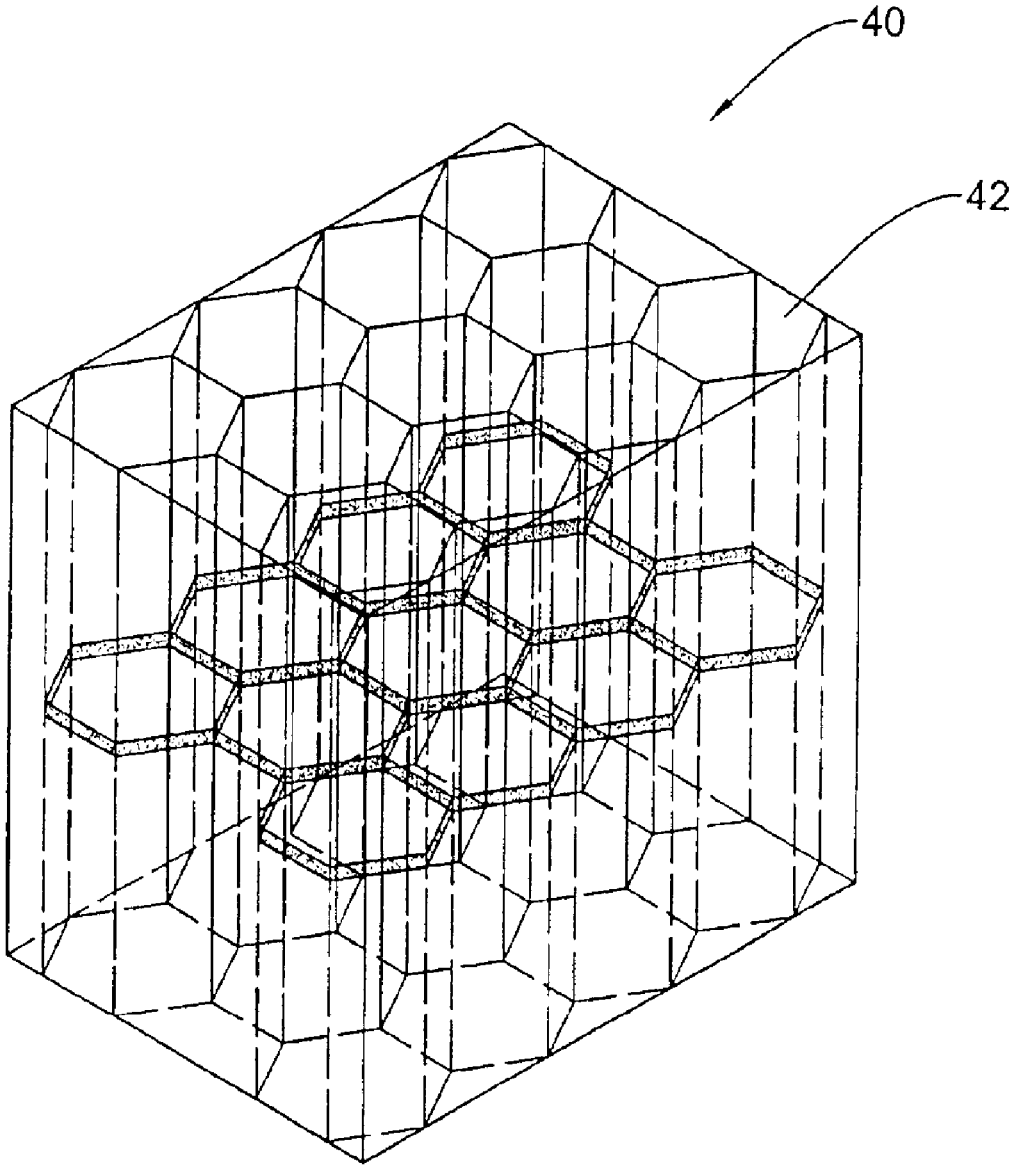
FIG. 11 illustrates a multi-dielectric single array structure according a specific example of the invention utilizing a hexagonal honeycomb layer with upper and lower supporting dielectric skins.

FIG. 11 illustrates such a multi-dielectric single array structure 40 according to the invention utilizing a hexagonal honeycomb layer 42 (core) with upper and lower supporting dielectric skins each having a thickness t=0.3 mm (skin dielectric constant is equal to 2.6). The honeycomb is a heterogeneous structure made of two materials: air and a dielectric foil (with the foil thickness of 0.17 mm, and foil dielectric constant of 4.3), and has a hexagonal unit-cell diameter of 3 mm and honeycomb layer thickness of d=8 mm. The metal inclusions are realized by selected metal coating at the central plane of the structure, thus generating an array of hexagonal open conducting cylinders of a 0.4 mm height. The metal inclusion thus has the cross-section of the hexagon of a size defined by the honeycomb unit-cell.

Figure 12:
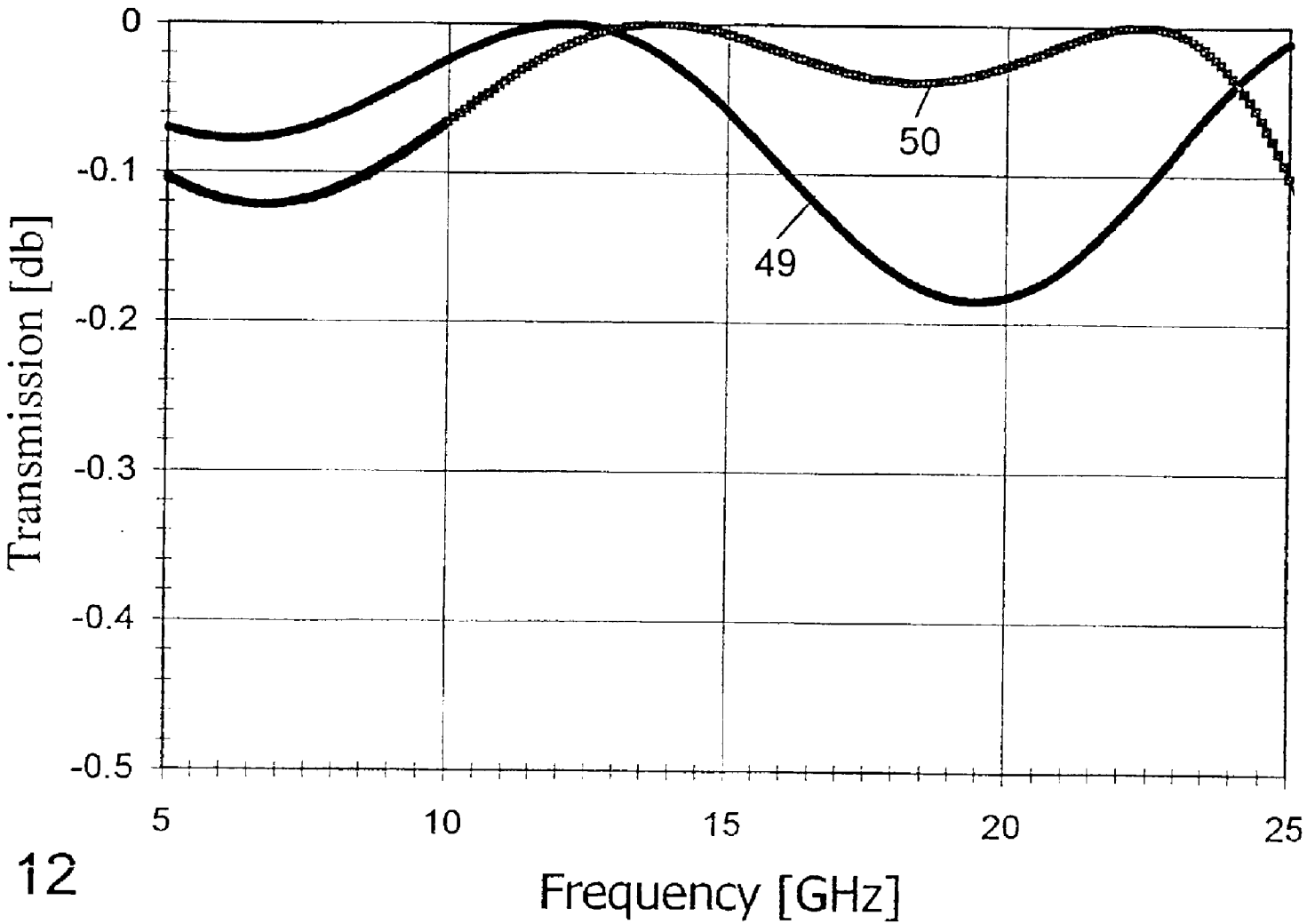
FIG. 12 illustrates the frequency variations of the transmission coefficient for the structure of FIG. 11 with and without the conductive inclusions.

FIG. 12 illustrates the transmission coefficient for the cases of the all-dielectric conventional radome (graph 49) and the metal-dielectric radome 40 of the present invention (graph 50). As shown, the transmission of the conventional radome structure has broadband characteristics with the degradation of the device performance towards the higher frequencies. By selective metalization of the honeycomb, the transmission at the frequency band of 14–23 GHz is improved with a little sacrifice at lower frequencies. The metal-dielectric radome 40 is characterized by a sharp degradation beyond 25 GHz, which is not observed in the conventional all-dielectric radome. Similar results could also be obtained by using the C-type radomes formed of two cores and three skin layers. In order to further compensate for the mismatch at the outer skins, an array of metallic patches could be printed on the inner skin.

The present invention provides for using high dielectric-constant skins and for compensating for their mismatch by the provision of a layer of metallic inclusions. It should, however, be noted that, if the use of thick low dielectric constant skins is required for a specific application (for example, to withstand the environment condition like hail-stone impact), the present invention provides for the compensation of the mismatch of such skins as well.

Figure 13:
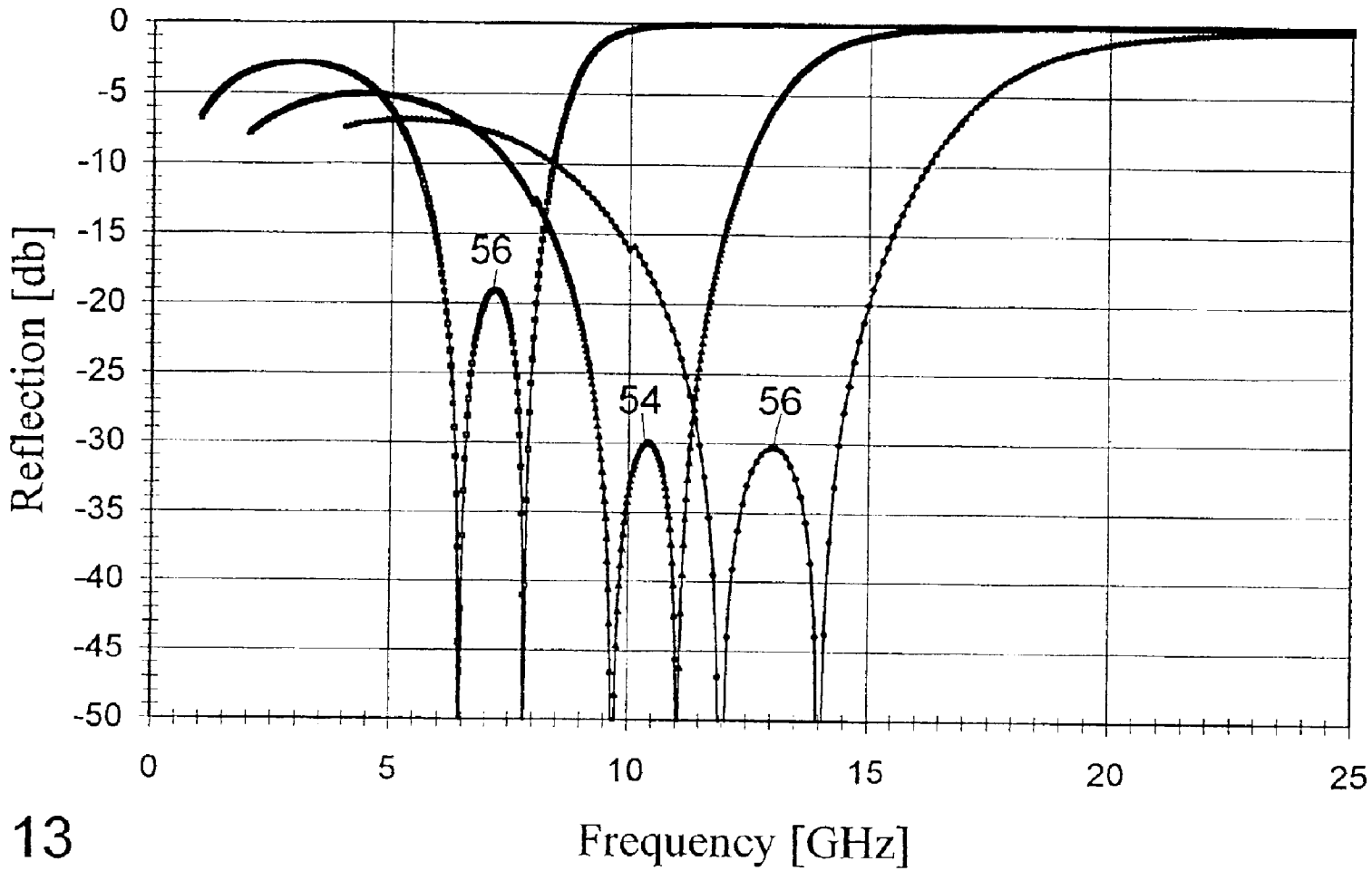
FIG. 13 illustrates the frequency variations of the reflection coefficient for window devices of three different examples of the present invention characterized by the different thickness of the skins.

FIG. 13 illustrates three graphs 52, 54 and 56 in the form of the reflection coefficient as functions of frequency, for three different examples, respectively. In all the examples, a foam core (thickness d=8 mm) and two identical Duroid skins with $\epsilon$=10 are used, with one central plane of metallic inclusions. The thicknesses of the skins for these three examples are, respectively $t_1$=0.25 mm, $t_2$=0.5 mm and $t_3$=1.25 mm. As shown, in the three examples, low reflection window (at the −20 dB level) is observed at frequency ranges 10.5–15 GHz, 9–11.5 GHz and 6–8 GHZ, respectively.

The multi-dielectric, single metallic array design according to the present invention enables to obtain high reflection at frequencies above the transmission band. This very low transmission band can block interference effects, thereby providing a system filtration load on the electromagnetic window to enable a simpler and cheaper communication system. Such a window can also be used as a sub-reflector in dichroic multi-reflector systems, requiring that the sub-reflector is transparent for some frequencies and is totally reflective for other frequencies. Such dichroic reflectors are capable of efficiently using the common main reflector aperture for various frequency bands, and are therefore used in satellite systems.

The above-described metal-dielectric windows (single layer design or multi-dielectric single inclusions' array design) can be used as a basic stage (or building block) in more complex designs of multi-stage windows. The design of the multi-stage window is preferably such as to keep the symmetry of the entire structure. To achieve this, the stages may and may not be identical.

Figure 14:
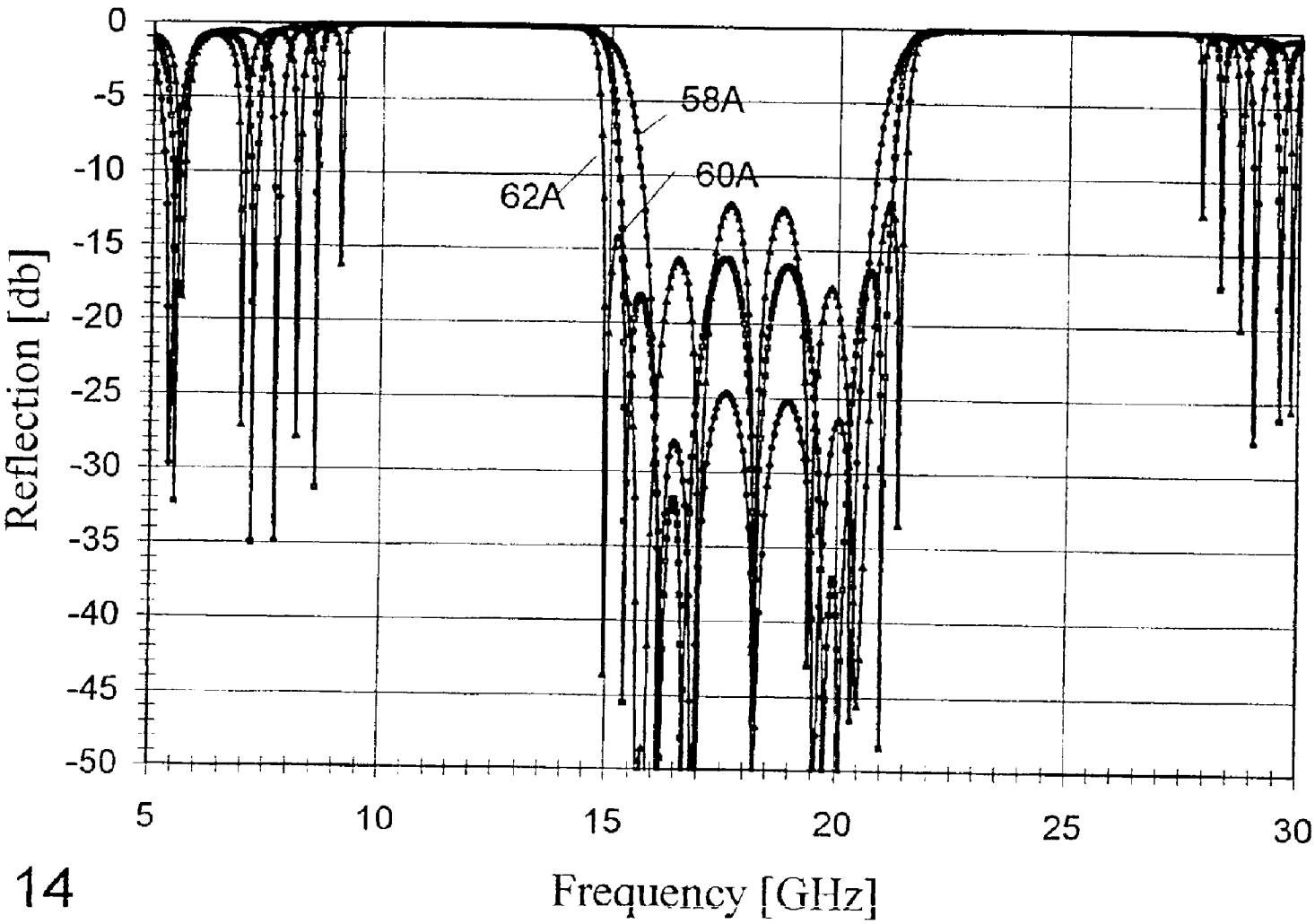
FIGS. 14 and 15 illustrate, respectively, the frequency variations of the reflection coefficient and the transmission coefficient, for four-, six- and eight-layers structures.
Figure 15:
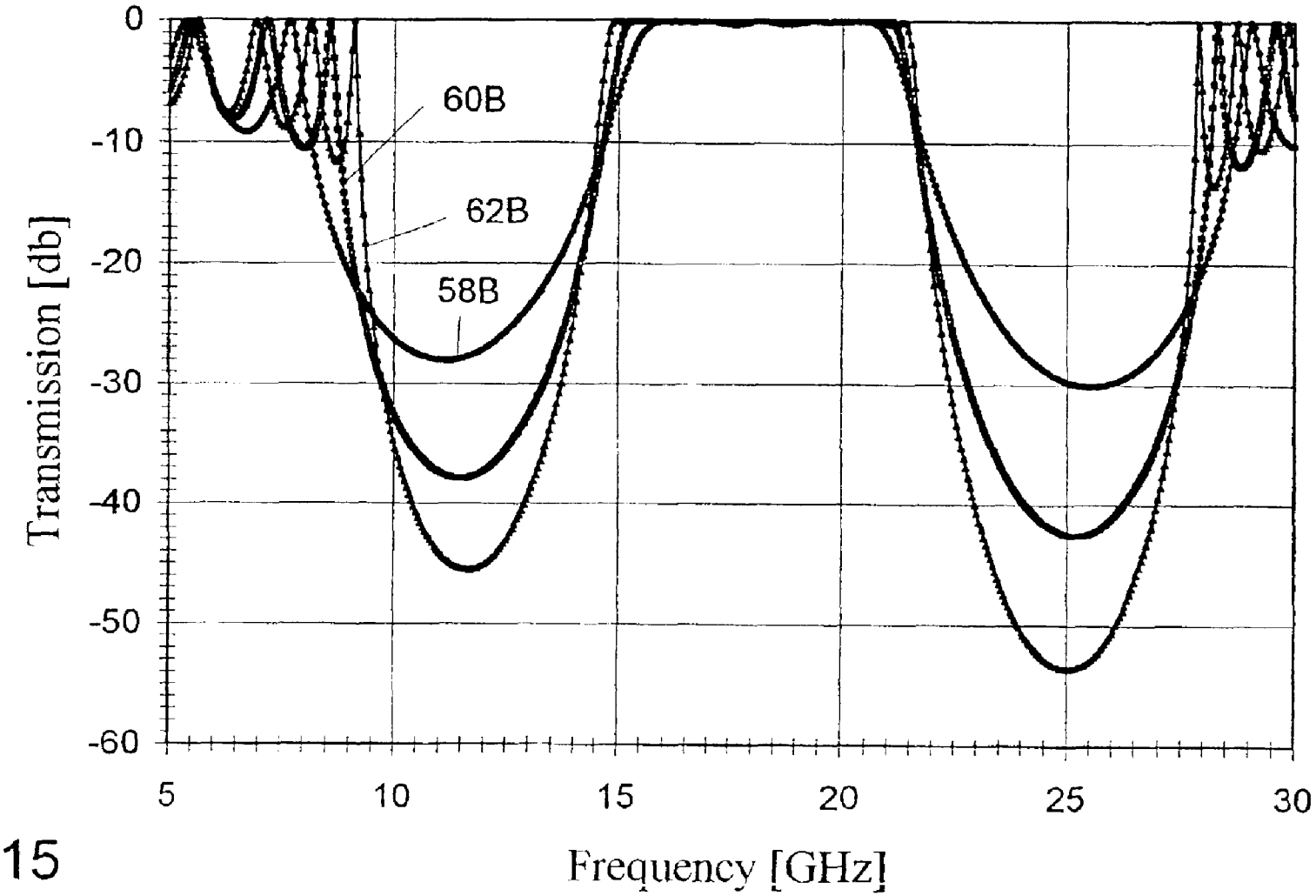

FIGS. 14 and 15 illustrate, respectively, the reflection coefficient as a function of frequency and the transmission coefficient as a function of frequency, characterizing the performance of three devices of different designs. Graphs 58A and 58B in FIGS. 14 and 15, respectively, correspond to the four-stage design of the window device, graphs 60A and 60B correspond to the six-stage design, and graphs 62A and 62B correspond to the eight-stage design.

It should be understood that here the term "stage" refers to a structure with a single metallic inclusions containing layer, whereas such a structure may include one dielectric layer or may be formed of a stack of dielectric layers. Hence, the multi-stage design is a stack of spaced-apart metallic inclusions (arrays) containing layers. Although multi-stage windows can be prohibitively thick at low microwave frequencies, at higher frequencies, they provide an additional degree of freedom for optimizing the device.

In this specific example, such a building block is a slab with the following parameters: $\epsilon_r$=8.8, d=4 mm, a=2 mm, r=0.85 mm. For each metal inclusion containing structure, the radii of all spheres were tuned to obtain the optimal response. The reflection and transmission of the window devices with the number n of stages being equal to 4, 6 and 8, respectively, demonstrate that the windows have the same central frequency. The advantage of employing a larger number of stages lies in sharpening the edges of the transmission band (FIG. 15). Additionally, as shown in the figures, the peak level of reflection inside the passband grows with the number of stages: (−25 dB) for 4-layer design, (−17 dB) for 6-layer design, and (−12 dB) for 8-layer design, thus increasing the transmission loss inside the transmission band.

The simulation results have shown that two broad stop-bands take place, one below the passband and the other above it. In this specific example of FIGS. 14 and 15, the lower stop-band is 9–15 GHz, and the upper stop-band is 22–28 GHz. If the same results are presented by plotting the transmission coefficient (FIG. 15), they show that the blockage in the stop bands deepens with the number of stages. These results are typical only for designs with high dielectric constant materials. For low dielectric constant devices, there are no real stop-bands, but rather a moderate level of reflection is observed in the range of (−1 dB)–(−6 dB).

Another important parameter is the slope of the transmission curve of FIG. 15 at the edges of the band. Considering two frequencies, one at −0.5 dB point and the other at −20 dB point at the higher edge, the ratios of the two frequencies for 4-, 6- and 8-stage designs are, respectively 1.09, 1.05 and 1.03. These results meet the requirements of satellite borne radiometers and sounders in the frequency range of 100 GHz–1 THZ (C. Antonopoulos et al., "Multilayer frequency selective surface for millimeter and submillimeter wave applications", Proc. IEE Microwaves Antennas and Propagation, Vol. 144, pp. 415–420, 1997).

Figure 16:
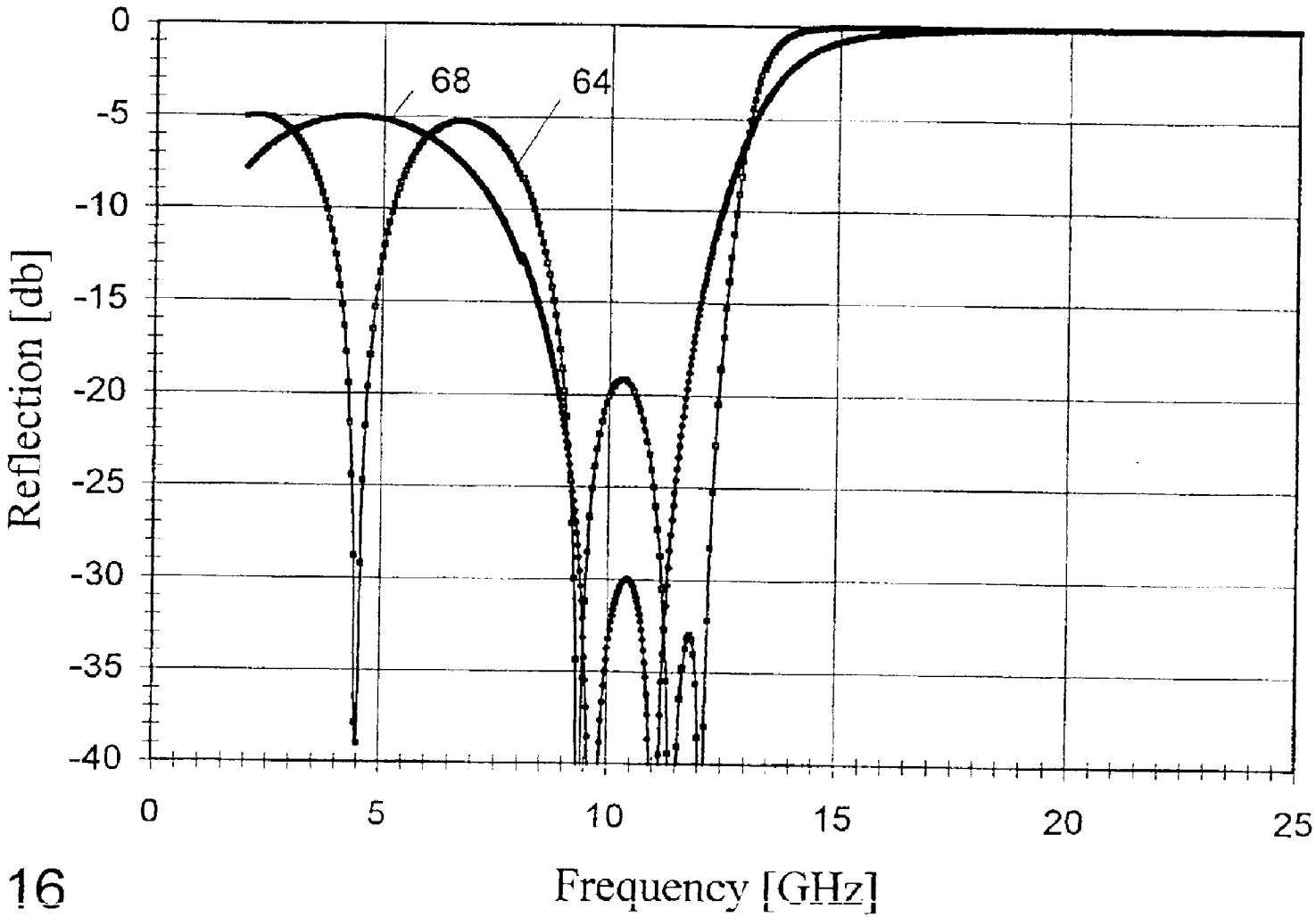
FIG. 16 illustrates the frequency variation of the reflection coefficient of both the "double-stage" and "single-stage" designs according to the invention.

In another example, two multi-layer windows each with a foam core of thickness d=8 mm, and two identical Duroid skins with $\in$=10, t=0.50 mm and one central plane of metallic inclusions, were stacked together. As shown in FIG. 16, comparing the frequency variation of the reflection coefficient of this "double-stage" window (graph 64) to that of the "single-stage" window (graph 68), the double-stage window presents a steeper transition into the transmission band, a wider transmission band, and better blockage at the frequency above the transmission band. In the present example of double-stage window, the edge frequency ratio is equal to 1.19.

If more than two stages (metal inclusion containing structures) are stacked with each other, a three dimensional grid is obtained. A four-stage device was tested, where inclusion layers 2 and 4 were shifted by half the grid constant along both the X- and the Y-axis. The performance of the window device was very little affected by this change.

Figure 17:
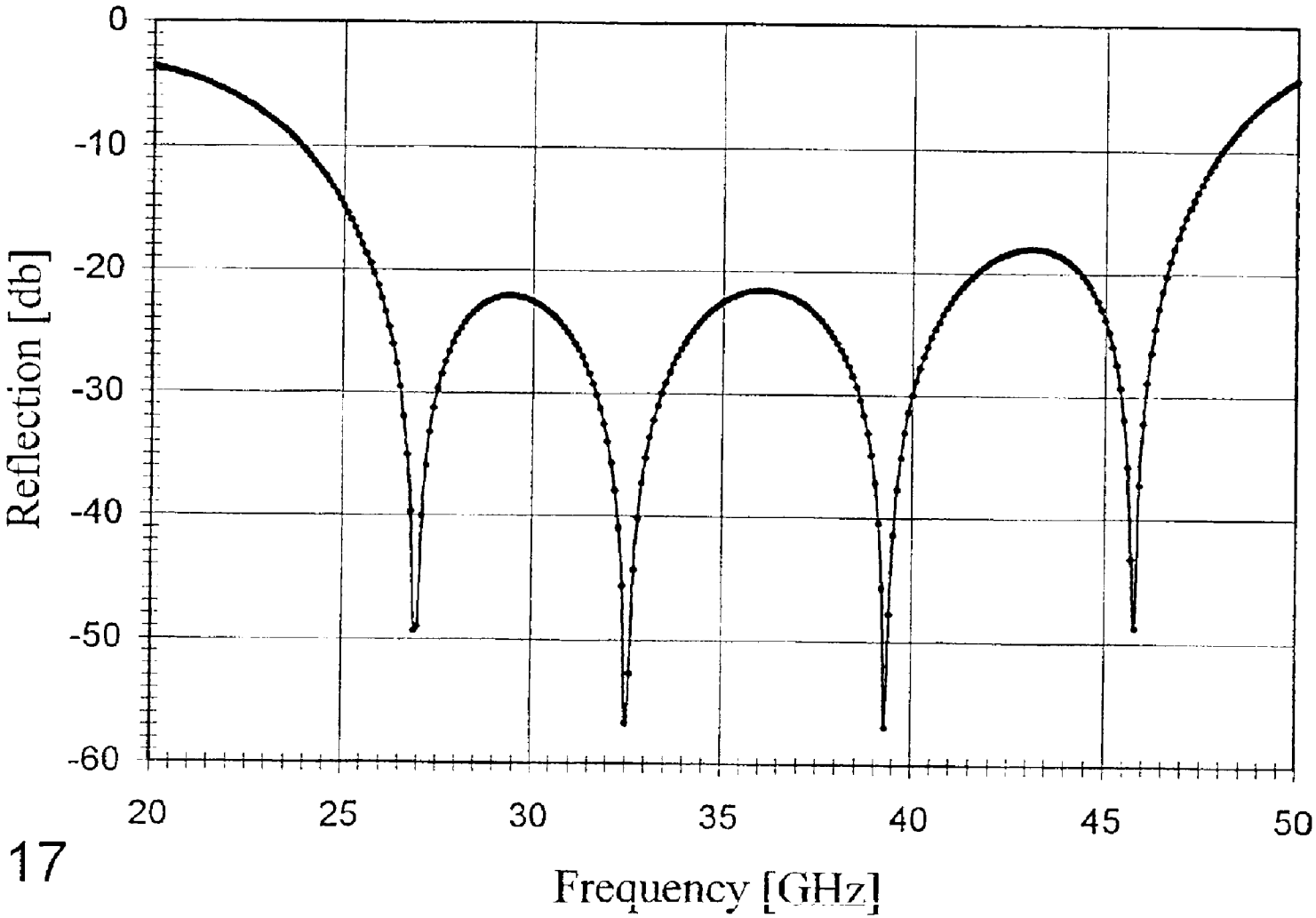
FIG. 17 illustrates how the transmission band is broadened with the use of a multi-stage design according to the invention (at normal incidence of electromagnetic radiation)

The multi-stage radomes improve the bandwidth of the window just by sharpening the transition regions. In order to provide significant improvement of the single-stage bandwidth, the stages can be separated by low dielectric spacers, and the window device can be tuned by controlling the thickness of the spacer. A window device composed of two stages each of $\in_r$=2.2, a=1.5 mm, d=4 mm, r=0.43 mm, and a spacer of $\in_r$=1.1 and thickness of 2 mm between them, was designed (the total thickness of such a composite window device being 10 mm). As shown in FIG. 17, at normal incidence of electromagnetic radiation on this window device, a transmission band in the range of 25–47 GHz with reflection lower than −15 dB (almost an octave bandwidth) was obtained.

As known, the ferroelectric materials are characterized by a change in their dielectric constant in response to the application of a DC voltage. The known ferroelectric materials are of ceramic nature, for example, $BaTiO_3$ and $SiTiO_3$.

Figure 18:
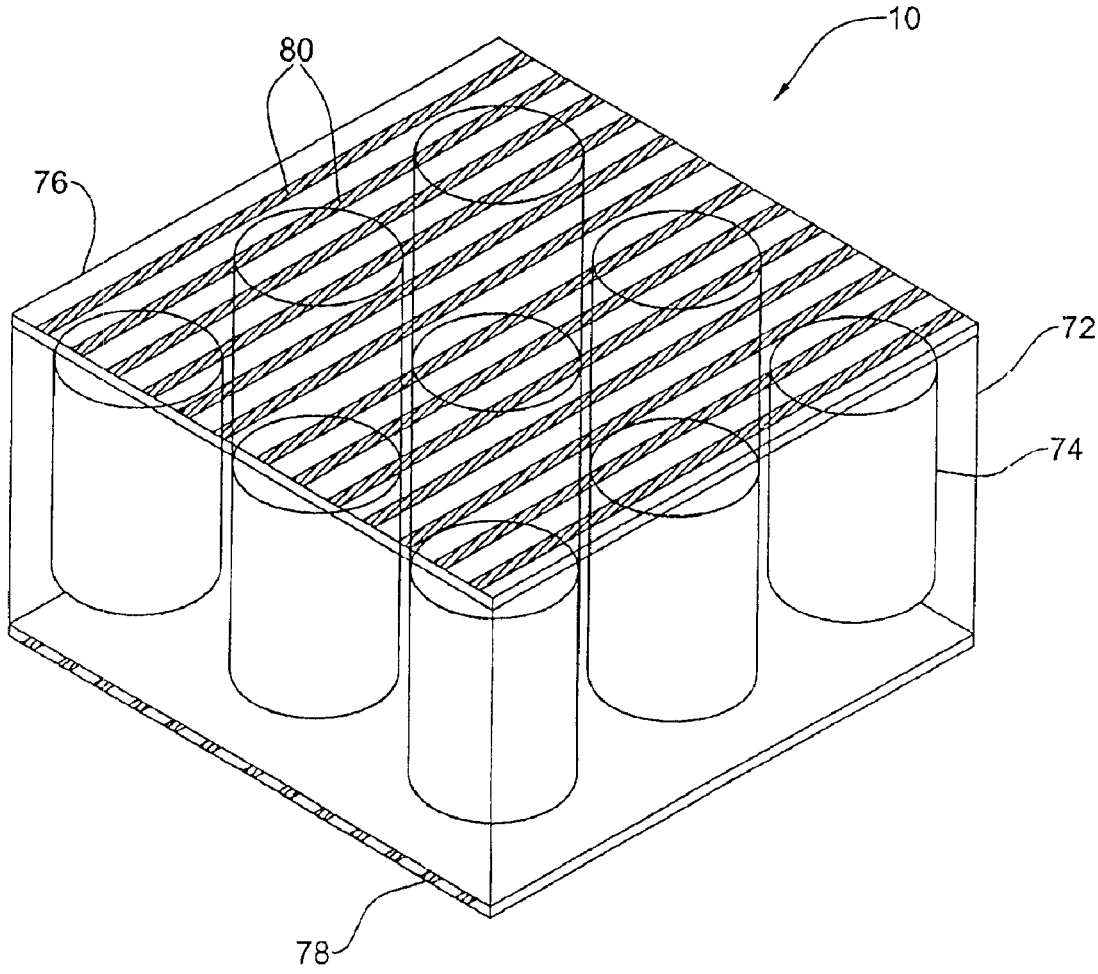
FIG. 18 illustrates an example of the controllable (tunable) window device according to the invention.

FIG. 18 illustrates an experimental controllable window device 70 according to the present invention based on a ceramic core (MgO or $SiO_2$) formed of a dielectric layer 72 with cylindrical metal inclusions (inner pattern) 74, and two external ferroelectric layers 76 and 78 of dielectric constant about 33. The DC voltage was supplied via a grid of parallel metal strips, generally at 80, printed on the ferroelectric layers. To this end, the high voltage strips and the grounded strips are interlaced, so as to generate high DC electric fields at the openings between the strips. The window was tuned by the inclusions 74 (i.e., the size of the cylinders and spaces between them were optimized) to compensate for both the reflection from the ferroelectric layers and the metal strips.

Figure 19A:
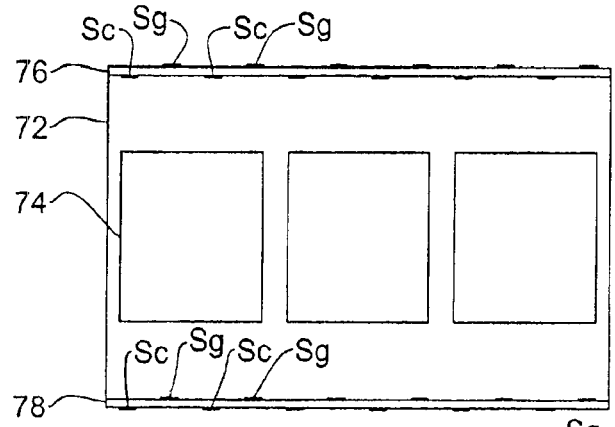
FIGS. 19A–19D illustrate, respectively, different strips arrangements suitable to be used in the device of FIG. 18.
Figure 19B:
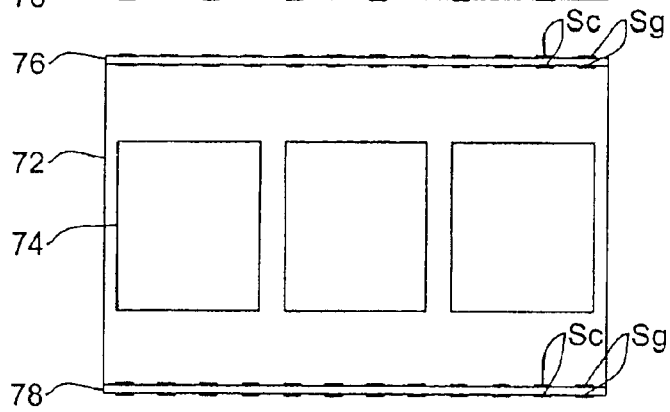
Figure 19C:
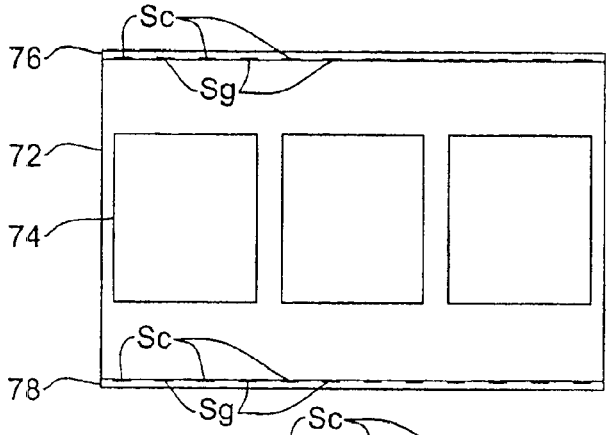
Figure 19D:
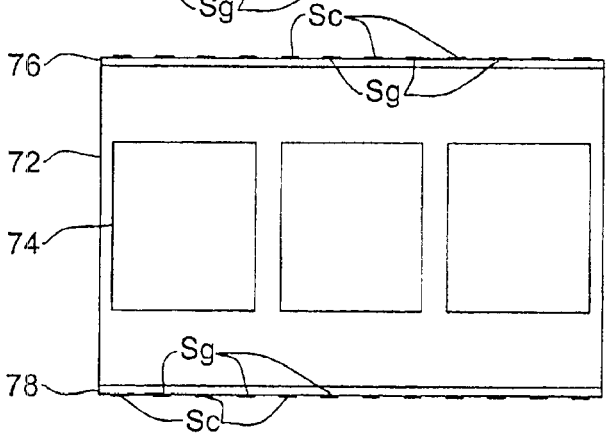

As shown in FIGS. 19A–19D, various strips' arrangements can be used, namely various ways of charging and grounding the strips, provided that a strong electric field is generated in the ferroelectric layers especially between the strips, where the electromagnetic radiation has the highest energy density. As shown, in all the arrangements the charged strips $S_c$ and the grounded strips $S_g$ are interlaced, irrespective of the surface the strips are printed on. In the examples of FIGS. 19A and 19B, the strips $S_c$ and $S_g$ are printed on the outer surfaces of the ferroelectric layers 76 and 78 and on the outer surfaces of the central dielectric layer 72. In the examples of FIGS. 19C and 19D, the strips $S_c$ and $S_g$ are printed on the outer surfaces of, respectively, the dielectric layer, and the ferroelectric layers.

Figure 20:
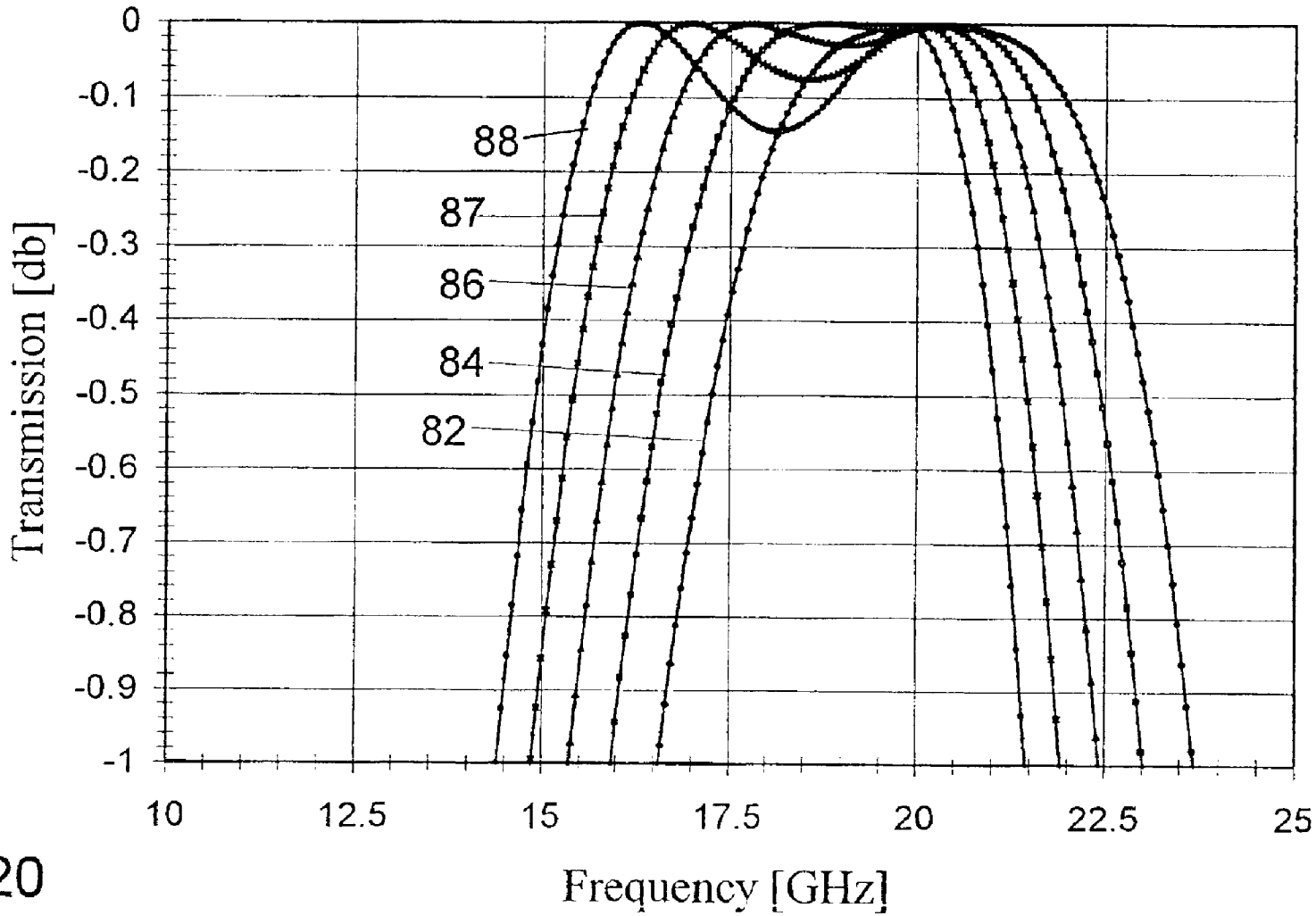
FIG. 20 illustrates the principles of tuning the device of FIG. 18, wherein different transmission curves of the device are obtained for different values of the dielectric constant of ferroelectric layers.

FIG. 20 illustrates the transmission curves of the window 70 simulated while varying the dielectric constant of the ferroelectric layers between 27 to 39. Four graphs 82, 84, 86 and 88 correspond to, respectively, the following values of dielectric constant: $\in_1$=27, $\in_2$=30, $\in_3$=33, $\in_4$=36 and $\in_5$=39. It is clear from the figure that the window keeps its high transparency, while the center frequency of the window is shifted from 20 GHZ to 18 GHz.

It should be noted that in the case of non-linear polarization of the incident radiation, e.g., circular polarization, the electric field component parallel to the strips (80 in FIG. 18) is strongly reflected, and the window device is not transparent any more. In order to reduce this reflection, high resistivity strips (e.g., with 1000–2000 Ohm/sq) can be used, thereby allowing the transmission of both polarizations at the expense of 1–2 dB transmission loss.

Those skilled in the art will readily appreciate that various modifications and changes can be applied to the embodiments of the invention as hereinbefore exemplified without departing from its scope defined in and by the appended claims. The dielectric structure may be in the form of a slab or a composite structure (core and skins). The electrically conductive scattering inclusions may be voluminous (full or hollow), or printed conducting element (printed on skins), provided they are sub-resonant of capacitive electrical behavior.

What is claimed is:

1. A device configured to be substantially transparent to electromagnetic radiation of a certain frequency band defined by two frequencies $F_1$ and $F_2$ of the maximal transparency of the device, the device comprising at least one dielectric structure of a predetermined thickness loaded with inclusions forming a predetermined substantially periodic pattern inside said at least one dielectric structure, wherein a value of said predetermined thickness is defined by a central frequency between said frequencies $F_1$ and $F_2$ and is such that said at least one dielectric structure in its unloaded state has minimal transparency for said central frequency, and the inner pattern is formed by a two-dimensional array of spaced-apart substantially identical sub-resonant capacitive elements, which are disconnected from each other and are made of an electrically conducting material capable of scattering the electromagnetic radiation, said capacitive elements having a geometry and size and being spaced from one another in an array such that the device is tuned to be substantially transparent to said frequencies $F_1$ and $F_2$.

2. The device according to claim 1, wherein the periodicity of said inner pattern is such that average density of the elements is approximately the same all along a patterned area.

3. The device according to claim 1, wherein dimensions of the radiation scattering elements and spaces between them are selected such that the scattering from said elements substantially compensates for reflection effects from dielectric discontinuities at and inside the device.

4. The device according to claim 1, wherein the array of said elements is positioned in a plane located at the middle of the dielectric structure parallel to planes defined by upper and lower surfaces of the dielectric structure.

5. The device according to claim 1, wherein the size of the electrically conductive element is such that the fundamental resonance frequency of the element is above said certain frequency band.

6. The device according to claim 1, wherein the thickness of the dielectric structure is such that the dielectric structure without the inner pattern has first and second reflection minima in the frequency domain, the center of said certain frequency band of the device being approximately a mid point between said first and second reflection minima.

7. The device according to claim 1, wherein the dielectric structure comprises a single dielectric layer formed with said inner pattern.

8. The device according to claim 7, wherein the electrically conductive element has the size smaller than the half-wavelength of propagation of said electromagnetic radiation in said dielectric structure.

9. The device according to claim 7, wherein the thickness of the dielectric layer is about 0.75, wherein is the wavelength of propagation of said radiation in the dielectric layer.

10. The device according to claim 1, wherein said at least one structure is a substantially symmetrical structure formed by a stack of dielectric layers, wherein the central dielectric layer is formed with said inner pattern.

11. The device according to claim 10, wherein the dielectric layers are made of different dielectric materials characterized by different wavelengths of propagation of said electromagnetic radiation.

12. The device according to claim 11, wherein the electrically conductive element has the size smaller than the half of at least maximal wavelength of propagation of said electromagnetic radiation in said dielectric structure.

13. The device according to claim 11, wherein the thickness of the device is in the range from three quarters of the shortest wavelength and three quarters of the longest wavelength of radiation propagation in the different dielectric layers at the central frequency of said frequency band.

14. The device according to claim 1, wherein said elements are made of a metal-containing material.

15. The device according to claim 1, wherein said elements are formed by coating conductive elements with one or more dielectric layers.

16. The device according to claim 1, wherein said elements are formed by coating dielectric elements by at least one conducting layer.

17. The device according to claim 1, wherein said elements are formed by selective coating of through-holes or honeycomb cores.

18. The device according to claim 1, wherein said at least one dielectric structure has a constant thickness all along its length, thereby providing a constant thickness of the device all along the device.

19. The device according to claim 1, wherein said at least one dielectric structure has a varying thickness all along its length, thereby providing a varying thickness of the device all along the device.

20. The device according to claim 1, wherein said elements have circular or polygonal cross-section.

21. The device according to claim 1, wherein said elements are voluminous.

22. The device according to claim 1, and also comprising electrically conductive strips arranged in a spaced-apart parallel relationship on opposite surfaces of said at least one dielectric structure.

23. The device according to claim 1, and also comprising at least two layers made of a ferroelectric material at opposite sides of said at least one dielectric structure.

24. The device according to claim 23, wherein said ferroelectric layers are formed with electrically conductive strips arranged in a spaced-apart parallel relationship to be charged and grounded during an application of an electric field to the ferroelectric layers.

25. The device according to claim 1, capable of transmitting the electromagnetic radiation impinging thereon at an angle of incidence up to 60 degrees.

26. The device according to claim 1, and also comprising at least one additional dielectric structure with a predetermined substantially periodic inner pattern formed by a two-dimensional array of spaced-apart substantially identical sub-resonant capacitive elements made of an electrically conducting material and capable of scattering said electromagnetic radiation, and arranged in a disconnected from each other spaced-apart relationship, the at least two structures being located one above the other.

27. A device substantially transparent to electromagnetic radiation of a certain frequency band defined by two frequencies $F_1$ and $F_2$ of the maximal transparency of the device, the device comprising at least one dielectric structure of a thickness of about 0.75 $\lambda$, wherein $\lambda$ is the wavelength of propagation of said radiation in the dielectric structure; said dielectric structure being loaded with inclusions forming a predetermined substantially periodic pattern inside said at least one dielectric structure, said thickness of said at least one dielectric structure causing said at least one dielectric structure, in its unloaded state, to have minimal transparency for a central frequency between said two frequencies $F_1$ and $F_2$ said periodic, pattern being formed by a two-dimensional array of spaced-apart substantially identical sub-resonant capacitive elements, which are disconnected from each other and are made of an electrically conducting material capable of scattering the electromagnetic radiation, said elements having a geometry and size and being space from one another in an array such that the device is tuned to be substantially transparent to said frequencies $F_1$ and $F_2$.

28. A device substantially transparent to electromagnetic radiation of a certain frequency band defined by two frequencies $F_1$ and $F_2$ of the maximal transparency of the device, the device comprising a dielectric layer of a thickness of about 0.75 $\lambda$, wherein $\lambda$ is the wavelength of propagation of said radiation in the dielectric layer, said dielectric layer being loaded with inclusions forming a predetermined substantially periodic pattern inside said dielectric layer, said thickness of the dielectric layer causing said dielectric layer, in its unloaded state, to have minimal transparency for a central frequency between said two frequencies $F_1$ and $F_2$, said pattern inside said dielectric layer being formed by a two-dimensional array of spaced-apart substantially identical sub-resonant capacitive elements, which are disconnected from each other and are made of an electrically conducting material capable of scattering the electromagnetic radiation, each of the elements having a size smaller than $\lambda/2$, said elements having a geometry and being spaced from another in an array such that the device is tuned to be substantially transparent to said frequencies $F_1$ and $F_2$.

29. A radiation source for generating electromagnetic radiation of a certain frequency band, the radiation source comprising the device constructed according to claim 1, accommodated adjacent to an emitter of the electromagnetic radiation.

30. A frequency-selective multi-reflector device comprising a sub-reflector element substantially transparent for certain frequencies and totally reflective for other frequencies, wherein said sub-reflector is the device of claim 10.

31. A radiation source for generating electromagnetic radiation of a certain frequency band, the radiation source comprising an emitter of the electromagnetic radiation, and a window device accommodated adjacent to said emitter and being substantially transparent with respect to said certain frequency band of the electromagnetic radiation, said band being defined by two frequencies $F_1$ and $F_2$ of the maximal transparency of the window device, the window device comprising at least one dielectric structure of a predetermined thickness, and loaded with inclusions forming a predetermined substantially periodic pattern inside said at least one dielectric structure, wherein a value of said predetermined thickness is defined by a central frequency between said two frequencies $F_1$ and $F_2$ and is such that said at least one dielectric structure in its unloaded state has minimal transparency for said central frequency between said two frequencies $F_1$ and $F_2$, and said periodic pattern is formed by a two-dimensional array of spaced-apart substantially identical sub-resonant capacitive elements, which are disconnected from each other and are made of an electrically conducting material capable of scattering the electromagnetic radiation, said elements having a geometry and size and being spaced from one another in an array such that the window device is tuned to be substantially transparent to said frequencies $F_1$ and $F_2$.

32. A controllable device for transmitting electromagnetic radiation of a certain frequency band defined by two frequencies $F_1$ and $F_2$ of the maximal transparency of the window device, the device comprising:

at least one dielectric structure of a predetermined thickness, which is defined by a central frequency between said two frequencies $F_1$ and $F_2$ and is such that said at least one dielectric structure in an unloaded state has minimal transparency for the central frequency between said two frequencies $F_1$ and $F_2$;

an inner pattern formed by inclusions inside said at least one dielectric structure, the pattern being in the form of a two-dimensional array of substantially identical electrically conductive sub-resonant capacitive elements capable of scattering said electromagnetic radiation, said elements being disconnected from each other in a spaced-apart relationship, and having a geometry and size to enable tuning of the window device to be substantially transparent to said frequencies $F_1$ and $F_2$; and at least two ferroelectric layers located at opposite sides of said at least one dielectric structure, such that application of an electric field to said ferroelectric layer effects a change in a dielectric constant of said ferroelectric layer.

33. A method for constructing a device to be substantially transparent to electromagnetic radiation of a certain frequency band defined by two frequencies $F_1$ and $F_2$ of the maximal transparency of the window device, the method comprising: fabricating at least one dielectric structure made from at least one dielectric material of a predetermined dielectric constant and having a predetermined thickness, which is defined by a central frequency between said two frequencies $F_1$ and $F_2$ and is such that said at least one dielectric structure in an unloaded state has minimal transparency for the central frequency between said two frequencies $F_1$ and $F_2$; and loading said at least one dielectric structure with inclusions forming an inner pattern inside said at least one dielectric structure in the form of a two-dimensional array of substantially identical sub-resonant capacitive electrically conductive scattering elements arranged in a disconnected spaced-apart relationship, the geometry and size of the electrically conductive scattering elements being provided with a geometry and size and a spacing and between the elements to ensure that the scattering from said elements compensates for reflection effects from the dielectric discontinuities to thereby tune the device to be substantially transparent to said frequencies $F_1$ and $F_2$.

34. The device according to claim 1, wherein the thickness of the dielectric structure is such that said dielectric structure in its unloaded state, free of any inclusions, is maximally reflective to said central frequency and is maximally transparent for a certain non-zero frequency lower than said frequency band.

35. A device configured to be maximally transparent to electromagnetic radiation of two predetermined frequencies $F_1$ and $F_2$, the device comprising:

at least one dielectric structure made of a certain dielectric material with a certain dielectric constant, said at least one dielectric structure having a thickness selected to define a central frequency between said frequencies $F_1$ and $F_2$ and is of about three quarters of a wavelength of propagation of the electromagnetic radiation in said dielectric structure at said central frequency;

a plurality of inclusions defining a substantially periodic pattern of electrically conductive elements inside the dielectric material, said inclusions consisting of an array of substantially identical sub-resonant capacitive elements disconnected from each other, and having a geometry and size with spaces between each other in the array such that the device is tuned to be substantially transparent to said frequencies $F_1$ and $F_2$, said device being tuned by balancing the radiation reflected from dielectric discontinuities of the dielectric structure with the radiation scattered from the conducting inclusions.

36. A device configured to be maximally transparent to electromagnetic radiation of two predetermined frequencies $F_1$ and $F_2$, the device comprising:

at least one dielectric structure having a thicknesses selected to define a central frequency between said frequencies $F_1$ and $F_2$, such that the dielectric structure in an unloaded state, free of any inclusions, has minimal transparency for the central frequency between said frequencies $F_1$ and $F_2$ and is maximally transparent for a certain non-zero frequency lower than said frequencies $F_1$ and $F_2$;

a plurality of inclusions defining a substantially periodic pattern of electrically conductive elements inside said dielectric structure, said inclusions consisting of a plurality of substantially identical sub-resonant capacitive elements disconnected from each other, and having a geometry, size and spaces between one another such that the device is tuned to be maximally transparent to said frequencies $F_1$ and $F_2$, said device being tuned by balancing the radiation reflected from dielectric discontinuities of the dielectric structure with the radiation scattered from the conducting inclusions.

37. A method for constructing a window device to be maximally transparent to electromagnetic radiation of predetermined frequencies $F_1$ and $F_2$, the method comprising:

providing at least one dielectric structure made from at least one dielectric material of a predetermined dielectric constant and having a predetermined thickness selected to define a central frequency between said frequencies $F_1$ and $F_2$, said thickness being such that said dielectric structure in an unloaded state, free of any inclusions, has minimal transparency for said central frequency between the frequencies $F_1$ and $F_2$ and is transparent for a certain non-zero frequency lower than said frequencies $F_1$ and $F_2$;

loading the dielectric structure with electrically conductive inclusions forming an inner pattern inside the dielectric structure, said inner pattern of the inclusions consisting of an array of substantially identical, subresonant, capacitive, electrically conductive, scattering elements arranged in a disconnected spaced-apart relationship, the geometry and size of the electrically conductive scattering elements and the spaces between the elements being selected so as to enable tuning of the window device to said frequencies $F_1$ and $F_2$ by balancing the radiation reflected from the dielectric discontinuities of the dielectric structure with the radiation scattered from said elements.

* * * * *